US010099908B1

(12) United States Patent
Kirkpatrick et al.

(10) Patent No.: US 10,099,908 B1
(45) **Date of Patent: *Oct. 16, 2018**

(54) LOAD-SUPPORTING APPARATUS AND LIFT FORMED THEREWITH

(71) Applicants: Michael W. Kirkpatrick, Buckeye, AZ (US); Justin D. Scheller, Laveen, AZ (US)

(72) Inventors: Michael W. Kirkpatrick, Buckeye, AZ (US); Justin D. Scheller, Laveen, AZ (US)

(73) Assignee: WK ENTERPRISES, LLC, Buckeye, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/601,950

(22) Filed: May 22, 2017

Related U.S. Application Data

(63) Continuation of application No. 14/957,289, filed on Dec. 2, 2015, now Pat. No. 9,695,023.

(51) Int. Cl.
*B66F 9/18* (2006.01)

(52) U.S. Cl.
CPC ..... *B66F 9/183* (2013.01)

(58) Field of Classification Search
CPC .. B66F 9/183; B66F 9/186; B66F 9/12; B66F 9/061; B66F 9/18; B66F 9/075; B66F 9/07522; B66F 9/122; B66F 9/127; B66F 9/142; B66F 9/143; B66F 9/185; B66F 9/19; B66C 23/44
USPC .... 414/23, 10–12, 24.5, 541, 542, 544, 545, 414/549
See application file for complete search history.

(56) References Cited

U.S. PATENT DOCUMENTS 3,029,962 A * 4/1962 Didtel ..... B66F 9/183 414/621
4,279,564 A * 7/1981 Weinert ..... B66F 9/183 414/621
4,549,845 A * 10/1985 Ramsey, Jr. ..... B66F 9/18 414/620
4,699,565 A * 10/1987 Seaberg ..... B66F 9/12 403/317
5,230,599 A * 7/1993 Orr ..... B66F 9/18 212/243

(Continued)

*Primary Examiner* — Kaitlin S Joerger
(74) *Attorney, Agent, or Firm* — Michael W. Goltry; Robert A. Parsons; Parsons & Goltry

(57) ABSTRACT

A load-supporting apparatus includes a pair of support assemblies each including a base, and a slide, formed with an abutment, mounted to the base for movement between a retracted position and an extended position relative to the base. The support assemblies extend in the same direction, and a linkage assembly interconnects the slides and enables adjustment of the support assemblies toward and away from one another. The abutments of the slides define contact points that engage and stabilize a load relative to the support assemblies, when the load is supported by the slides. The bases of the support assemblies are concurrently mountable releasably to a lift operable for raising and lowering the load-supporting apparatus between raised and lowered positions. The support assemblies are enabled for adjustment toward and away from one another via the linkage assembly, when the bases of the support assemblies are concurrently mounted releasably to the lift.

11 Claims, 38 Drawing Sheets

(56) References Cited

U.S. PATENT DOCUMENTS

| | | | | |
|---|---|---|---|---|
| 5,823,737 | A * | 10/1998 | Cook | B66F 9/183 414/451 |
| 6,287,073 | B1 * | 9/2001 | Lindgren | B66F 9/12 414/544 |
| 8,142,131 | B2 * | 3/2012 | Tygard | B66C 1/427 294/81.51 |
| 8,282,075 | B2 * | 10/2012 | Chan | B66F 3/46 254/1 |
| 8,814,238 | B2 * | 8/2014 | Tygard | B66F 9/183 294/81.51 |
| 9,073,716 | B2 * | 7/2015 | Brighenti | B65H 19/102 |
| 9,139,405 | B2 * | 9/2015 | Balcom | B66F 9/12 |
| 9,388,029 | B2 * | 7/2016 | Ziaylek | B65G 7/00 |
| 9,409,754 | B2 | 8/2016 | McGrane et al. | |
| 2012/0070259 | A1 * | 3/2012 | Altemeier | G05G 11/00 414/545 |
| 2012/0087769 | A1 * | 4/2012 | Michaels | B66F 9/065 414/621 |
| 2013/0259618 | A1 * | 10/2013 | McGrane | B66F 9/143 414/671 |
| 2014/0299826 | A1 * | 10/2014 | March | A61G 7/08 254/2 R |
| 2014/0374193 | A1 * | 12/2014 | Meijer | B66F 9/122 187/237 |
| 2015/0266709 | A1 * | 9/2015 | Tygard | B66F 9/183 414/623 |
| 2015/0375976 | A1 * | 12/2015 | Kuck | B66F 9/075 187/222 |
| 2016/0101794 | A1 * | 4/2016 | Fowler | B66F 9/18 254/2 R |
| 2016/0176690 | A1 * | 6/2016 | Iotti | B66F 9/143 414/621 |
| 2016/0214659 | A1 * | 7/2016 | Schmalzl | B62D 33/0608 |

* cited by examiner 210
211
213A
77'
60'
76'
70'
140'

214
213
160'
52
125'
77
61'
213B
80'
130
60
70
170
76
160
125
140
51
80
150
230
110
61
141
231
212

210
211
60'
71'
213A 60
71
50
230
125'
125
213
213B
52
160
160'
51
61
150'
150
61'
214
212

210
211
214
213A 77
76
60
213B
50
77
125
130
140
61
80
51
125'
130
55
77'
60'
76'
70
213
140'
170
80'
141'
52
240
152
212
241
110
61'
150'

210

211
77
60
130
125
213A
141
241
214
70
110
213
76
150
213B
80
160
61
112
151
152
212

LOAD-SUPPORTING APPARATUS AND LIFT FORMED THEREWITH

FIELD OF THE INVENTION

The present invention relates to lifts for lifting and lowering loads.

BACKGROUND OF THE INVENTION

The lifting and transport of goods in loads heavy enough to make manual lifting and loading undesirable has long been an area of innovation. Lifts of many types are commonly and successfully employed to load heavy goods and equipment onto platforms, racks, trailers, and into trucks. The problem with using conventional lifts is that they are not easily adjustable for accommodating differently-sized loads, interfere with loading and unloading heavy loads at loading and unloading areas, and are not constructed to satisfactorily stabilize heavy loads during lifting, loading, and unloading operations. Conventional lifts that support loads from the bottom, such as on lifting platforms, can damage sensitive loads, such as sensitive equipment and fixtures that are prone to damage under their own weight when not supported properly. Conventional lifts that suspend heavy loads during lifting and unloading operations, such as crane lifts and hoists, render the load unstable. Furthermore, the load-supporting assemblies of conventional lifts are often damaged during normal use, which can render them unsafe or inoperable. Unfortunately, replacing the load-supporting assemblies of conventional lifts is difficult, time-consuming, and expensive. Given these and other deficiencies inherent in the art, those of ordinary skill will readily appreciate that continued improvement in the art is evident.

SUMMARY OF THE INVENTION

According to the principle of the invention, a load-supporting apparatus includes first and second support assemblies each including a base, and a slide mounted to the base for movement between a retracted position and an extended position relative to the base. The slide includes upper and lower ends that extend from a proximal end toward the base to a distal end away from the base, inner and outer sides, and an abutment proximate to the lower end between the proximal and distal ends that extends inwardly from the inner side. The first and second support assemblies are axially spaced and extend in the same direction, and a linkage assembly couples the slide of the first support assembly to the slide of the second support assembly. The linkage assembly is adjustable in length for enabling adjustment of the first and second support assemblies toward and away from one another. The abutments define contact points that engage and stabilize a load relative to the first and second support assemblies, when the load is between and is supported by the slides. The bases of the first and second support assemblies are concurrently mountable releasably to a lift operable for raising and lowering the load-supporting apparatus between raised and lowered positions. The first and second support assemblies are enabled for adjustment toward and away from one another via the linkage assembly, when the bases of the first and second support assemblies are concurrently mounted releasably to the lift. The bases of the first and second support assemblies include first and second hooks, respectively, and the first and second support assemblies are concurrently mountable releasably to the lift with the hooks for releasably suspending the load-supporting apparatus from the lift. The first support assembly includes a first lock assembly, the slide of the first support assembly is disabled from moving between the retracted and extended positions, when the first lock assembly is locked, and the slide of the first support assembly is enabled for moving between the retracted and extended positions, when the first lock assembly is unlocked. The second support assembly includes a second lock assembly, the slide of the second support assembly is disabled from moving between the retracted and extended positions, when the second lock assembly is locked, and the slide of the second support assembly is enabled for moving between the retracted and extended positions, when the second lock assembly is unlocked. A first handle that extends upright from the upper end of the slide of the first support assembly, and a second handle that extends upright from the upper end of the slide of the second support assembly. The slides of the first and second support assemblies are parallel to each other. The first and second support assemblies each further include, a spacer, an engagement element carried by the spacer, and first and second engagement elements carried by the slide and the base, respectively. The spacer is in a stowage position releasably attached the base, when the engagement element of the spacer is releasably engaged to the first complemental engagement element. The spacer is in an operative position releasably attached to the slide extending forwardly from the abutment, when the engagement element of the spacer is releasably engaged to the second complemental engagement element. The spacers define extended contact points spaced forwardly from the contact points of the respective abutments that engage and stabilize the load relative to the first and second support assemblies, when the load is between and is supported by the slides. The second complemental engagement elements are carried by the abutments of the respective first and second support assemblies. The linkage assembly is capable of being locked and unlocked. The first and second support assemblies are disabled from moving toward and away from one another via the linkage assembly, when the linkage assembly is locked. The first and second support assemblies are enabled for moving toward and away from one another via the linkage assembly, when the linkage assembly is unlocked. A first stop element is carried by the base of the first support assembly, and a first complemental stop element is carried by the slide of the first support assembly. The first stop element engages the first complemental stop element when the slide of the first support assembly is in the extended position, disabling the slide of the first support assembly from moving beyond the extended position. A second stop element is carried by the base of the second support assembly, and a second complemental stop element is carried by the slide of the second support assembly. The second stop element engages the second complemental stop element when the slide of the second support assembly is in the extended position, disabling the slide of the second support assembly from moving beyond the extended position. The first and second support assemblies each further include a brace that depends downwardly from the base to a foot, and the foot of each of the braces engages a base of the lift, when the bases are mounted to the lift and the load-supporting apparatus is in the lowered position. In a particular embodiment, a cradle is formed in the distal end of the slide, and the contact points defined by the abutments engage and stabilize the load relative to the first and second support assemblies, when the load is between the slides and when trunnions of the load are pivotally supported by the respective cradles of the slides. In this embodiment, the spacers define the extended contact points spaced forwardly from the contact points of the respective abutments that engage and stabilize the load relative to the first and second support assemblies, when the load is between the slides and when the trunnions of the load are pivotally supported by the respective cradles of the slides. The second complemental engagement elements are carried by the abutments of the respective first and second support assemblies.

According to the principle of the invention, an apparatus includes a lift and a load-supporting apparatus. A backboard is mounted to the lift for moving the backboard in lifting and lowering directions, and the backboard includes an upper edge and a front surface. The load-supporting apparatus is carried by the backboard and includes first and second support assemblies each comprising a base, a hook carried by the base, and a slide mounted to the base for movement between a retracted position and an extended position relative to the base, the slide includes upper and lower ends that extend from a proximal end toward the base to a distal end away from the base, inner and outer sides, and an abutment proximate to the lower end between the proximal and distal ends that extends inwardly from the inner side. The first and second support assemblies are axially spaced and extend in the same direction, and a linkage assembly couples the slide of the first support assembly to the slide of the second support assembly, the linkage assembly is adjustable for enabling adjustment of the first and second support assemblies toward and away from one another. The abutments define contact points that engage and stabilize a load relative to the first and second support assemblies, when the load is between and is supported by the slides. Tithe load-supporting apparatus is suspended from the backboard with the hooks, in which the hooks are hooked over the upper edge of the backboard, the bases of the first and second support assemblies depend downwardly against the front surface of the backboard, and the slides of the respective first and second support assemblies concurrently extend horizontally forwardly from the linkage assembly, the bases of the respective first and second support assemblies, and the front surface of the backboard. The hooks and the bases are slidable back-and-forth across the upper edge and the front surface, respectively, of the backboard, which enables adjustment of the first and second support toward and away from one another via the linkage assembly. The first support assembly includes a first lock assembly, the slide of the first support assembly is disabled from moving between the retracted and extended positions, when the first lock assembly is locked; and the slide of the first support assembly is enabled for moving between the retracted and extended positions, when the first lock assembly is unlocked. The second support assembly includes a second lock assembly, the slide of the second support assembly is disabled from moving between the retracted and extended positions, when the second lock assembly is locked, and the slide of the second support assembly is enabled for moving between the retracted and extended positions, when the second lock assembly is unlocked. A first handle that extends upright from the upper end of the slide of the first support assembly, and a second handle that extends upright from the upper end of the slide of the second support assembly. The slides of the first and second support assemblies are parallel to each other. The first and second support assemblies each further include a spacer, an engagement element carried by the spacer, and first and second engagement elements carried by the slide and the base, respectively. The spacer is in a stowage position releasably attached the base, when the engagement element of the spacer is releasably engaged to the first complemental engagement element. The spacer is in an operative position releasably attached to the slide extending forwardly from the abutment, when the engagement element of the spacer is releasably engaged to the second complemental engagement element. The spacers define extended contact points spaced forwardly from the contact points of the respective abutments that engage and stabilize the load relative to the first and second support assemblies, when the load is between and is supported by the slides. The second complemental engagement elements are carried by the abutments of the respective first and second support assemblies. The linkage assembly is capable of being locked and unlocked. The first and second support assemblies are disabled from moving toward and away from one another via the linkage assembly, when the linkage assembly is locked. The first and second support assemblies are enabled for moving toward and away from one another via the linkage assembly, when the linkage assembly is unlocked. A first stop element is carried by the base of the first support assembly, a first complemental stop element is carried by the slide of the first support assembly, and the first stop element engages the first complemental stop element when the slide of the first support assembly is in the extended position, disabling the slide of the first support assembly from moving beyond the extended position. A second stop element is carried by the base of the second support assembly, a second complemental stop element is carried by the slide of the second support assembly, and the second stop element engages the second complemental stop element when the slide of the second support assembly is in the extended position, disabling the slide of the second support assembly from moving beyond the extended position. The first and second support assemblies each further include a brace that depends downwardly from the base to a foot, and the foot of each of the braces engages a base of the lift, when the bases are mounted to the lift and the load-supporting apparatus is in the lowered position. In a particular embodiment, a cradle is formed in the distal end of the slide, and the contact points defined by the abutments engage and stabilize the load relative to the first and second support assemblies, when the load is between the slides and when trunnions of the load are pivotally supported by the respective cradles of the slides. In this embodiment, the spacers define the extended contact points spaced forwardly from the contact points of the respective abutments that engage and stabilize the load relative to the first and second support assemblies, when the load is between the slides and when the trunnions of the load are pivotally supported by the respective cradles of the slides. The second complemental engagement elements are carried by the abutments of the respective first and second support assemblies.

Consistent with the foregoing summary of illustrative embodiments, and the ensuing detailed description, which are to be taken together, the invention also contemplates associated apparatus and method embodiments.

BRIEF DESCRIPTION OF THE DRAWINGS

Referring to the drawings.

DETAILED DESCRIPTION

Figure 1:
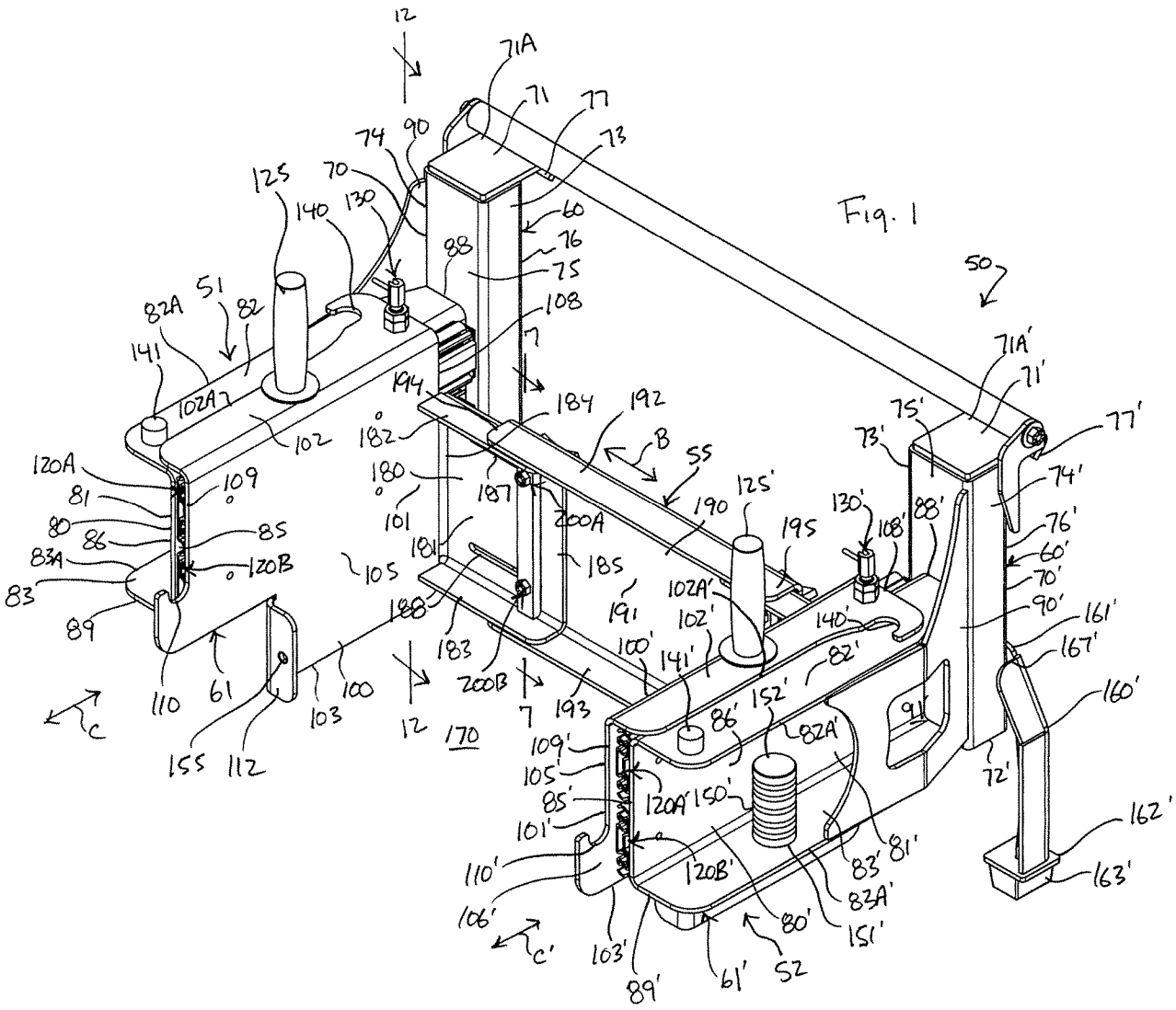
FIG. 1 is a top left perspective view of a load-supporting apparatus constructed and arranged in accordance with the principle of the invention and shown as it would appear retracted.

A load-supporting apparatus mountable releasably to a lift operable for raising and lowering the load-supporting apparatus between raised and lowered positions for raising and lowering loads carried by the load-supporting apparatus, and a lift incorporating the load-supporting apparatus are disclosed.

Turning now to the drawings, in which like reference characters indicate corresponding elements throughout the several views, attention is directed in relevant part to FIGS. 1-6 in which there is seen a load-supporting apparatus 50 constructed and arranged in accordance with the principle of the invention and that is configured to be easily suspended from a lift without the use of separate tools and without having to modify the load-supporting apparatus or the lift and without the need for separate mechanical fasteners, the lift being operable for raising and lowering the load-supporting apparatus between raised and lowered positions for raising and lowering loads carried by the load-supporting apparatus. Load-supporting apparatus 50 includes support assemblies 51 and 52, and a linkage assembly 55 coupling support assembly 51 to support assembly 52. Linkage assembly 55 between support assemblies 51 and 52 is adjustable in length for enabling adjustment of support assemblies 51 and 52 in reciprocal directions toward and away from one another. Support assemblies 51 and 52 oppose one another and are axially spaced apart and are coupled together via linkage assembly 55 for relative movement of support assemblies 51 and 52 in reciprocal directions relative to one another as indicated by the double arrowed line B in FIGS. 1 and 2 away from one another in FIGS. 1-6 and toward one another in FIGS. 9-11, 13, and 15. Support assemblies 51 and 52 are the mirror image of one another and are identical in every respect. Accordingly, the following description of support assembly 51 applies in every respect to support assembly 52. Support assemblies 51 and 52 are given the same reference characters when called out, and the reference numerals of second support assembly 52 include prime ("′") symbols for ease of reference when called out in conjunction with support assembly 52.

With continuing reference in relevant part to FIGS. 1-6, support assembly 51 includes base 60, mountable releasably to a lift, and slide 61. Slide 61 is mounted to base 60 for movement in reciprocal directions indicated by double arrowed line C in FIGS. 1 and 2 between a retracted position relative to base 60 in FIGS. 1 and 2, and an extended position relative to base 60 in FIGS. 13 and 14. Base 60 and slide 61 are fashioned of steel, aluminum or other metal or metal composite having inherently rugged, impact resistant, strong, and rigid material characteristics.

Base 60 includes an upstanding elongate support 70 and a beam 80. Elongate support 70, a piece of square, tubular stock in this example for strength, has upper end 71, lower end 72, and opposed inner and outer sides 73 and 74, a front 75, and an opposed back 76 that together extend from upper end 71 to lower end 72. An extension 71A of upper end extends rearward from back 76 to hook 77, which hooks downwardly for suspending support assembly 51 from a lift as described in detail below.

Beam 80 is connected elongate support 71 and is a structural element that is capable of withstanding load primarily by resisting bending. Beam 80, a C-beam in this example having a C-shaped cross-section, includes a vertical web 81, upper flange 82 that defines an upper end of beam 80, and lower flange 83 that defines a lower end of beam 80. For reference purposes and ease of discussion, reference character 82 is used interchangeably for denoting the upper end of beam 80 and the upper flange of beam 80, and reference character 83 is used interchangeably for denoting both the lower end of beam 80 and the lower flange of beam 80. Web 81 has inner side 85 and outer side 86 and extends upright between upper and lower flanges 82 and 83, i.e. the upper and lower ends of beam 80, which are horizontal and which extend outwardly in the same direction from outer side of web 81 to outer edges 82A and 83B, respectively. Upper and lower flanges 82 and 83 are horizontal and are perpendicular relative to web 81, and are parallel relative to each other. Web 81 and upper and lower flanges 82 and 83 that form beam 80 define inner or proximal end 88 of beam 80 and outer or distal end 89 of beam 80. Web 81 and upper and lower flanges 82 and 83 extend from proximal end 88 of beam 80 to distal end 89 of beam 80.

Proximal end 88 of beam 80 is affixed rigidly, via welding in this example, to front 75 of elongate support 70 between upper end 71 and lower end 72. Beam 80 is perpendicular relative to vertical elongate support 70, and extends horizontally outward or otherwise forward from proximal end 88, affixed rigidly to front 75, to distal end 89, and extends upright from lower flange 83, i.e. the lower end of beam 80, to upper flange 82, i.e. the upper end of beam 100. A bracket 90 is affixed rigidly via welding to front 75 of elongate support 70 proximate to side 74 along the length of elongate support 70 from proximate to upper end 71 to proximate to lower end 72. Bracket 90 extends outwardly or otherwise forward from front 75 of elongate support and is concurrently affixed rigidly via welding to outer edges 82A and 83A of upper and lower flanges 82 and 83 from proximal end 88 at front 75 of elongate support 70 to an intermediate location of beam 80 between proximal end 88 and distal end 89. Bracket 90 is spaced apart from outer side 86 of web 81, strengthens the attachment of beam 80 to elongate support 70, and cooperates with web 81 and upper and lower flanges 82 and 83 to form a box structure 91, which strengthens the capability of beam 80 of withstand load primarily by resisting bending.

Slide 61 is a beam 100 that is mounted reciprocally to beam 80 for movement between retracted and extended positions. Beams 80 and 100 cooperate to form a beam assembly. Beam 100 is a structural element that is capable of withstanding load primarily by resisting bending, like that of beam 80. Beam 100 includes a vertical web 101, and upper flange 102. Web 101 has inner side 105 and outer side 106 and extends upright between upper flange 102, which defines an upper end of beam 100 of slide 61, and a lower edge 103, that defines a lower end of beam 100 of slide 61. Upper flange 102 extends outwardly from outer side 106 of web 101 to outer edge 102A. Upper flange 102 is horizontal and is perpendicular relative to web 81. For reference purposes and ease of discussion, reference character 102 is used interchangeably to denote both the upper end of beam 100 of slide 61 and the upper flange of beam 100 of slide 61, and reference character 103 denotes both the lower end of beam 100 of slide 61 and the lower edge of beam 100 of slide 61. Web 101 and upper flange 102 define the inner or proximal end 108 of beam 100 and the outer or distal end 109 of beam 100. Beam 100 of slide 61 extends from proximal end 108 to distal end 109. Cradle 110 is formed in distal end 109. Cradle 110 is between upper end 102 and lower end 103, is closer to lower end 103 than to upper end 102, and is a hook that hooks upwardly toward upper end 102 of beam 100 of slide 61 for serving as a pivotal mount, such as for a trunnion of a load to be lifted. And so slide 61 includes beam 100 having upper end 102 and lower end 103 that extend from proximal end 108 to cradle 110 at distal end 109. Abutment 112 is formed in web 101 of beam 100 proximate to the lower end of slide 61 between proximal and distal ends 108 and 109 of beam 100 of slide 61, is vertical, and extends inwardly from inner side 105 in the opposite direction of upper flange 102. Abutment 112 is proximate to lower end 103 and is between proximal end 108 and cradle 110 of distal end 109. Abutment 112 functions as a contact point that engages and stabilizes a load carried by load-supporting apparatus 50.

Figure 2:
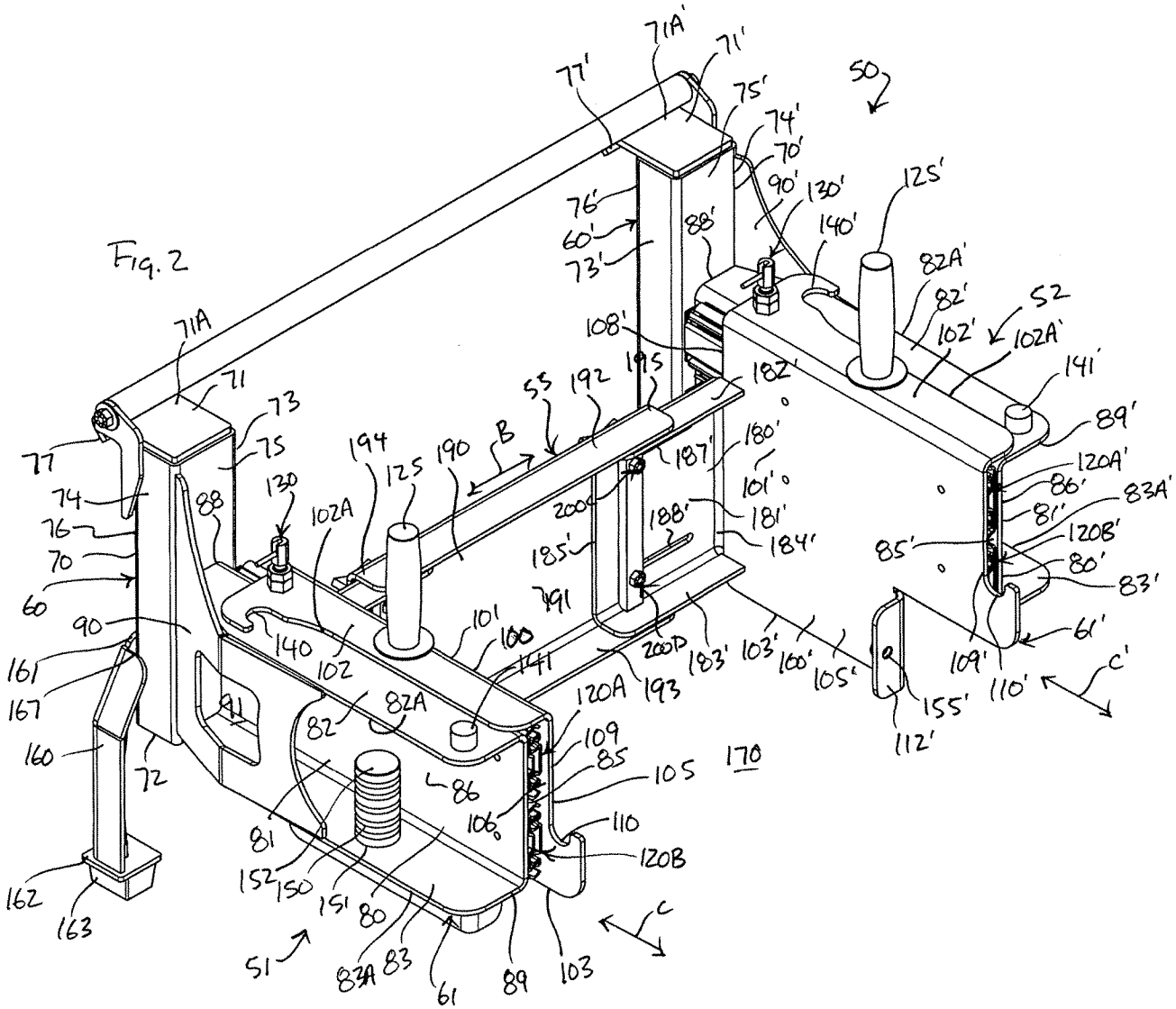
FIG. 2 is a top right perspective view of the embodiment of FIG. 1.
Figure 13:
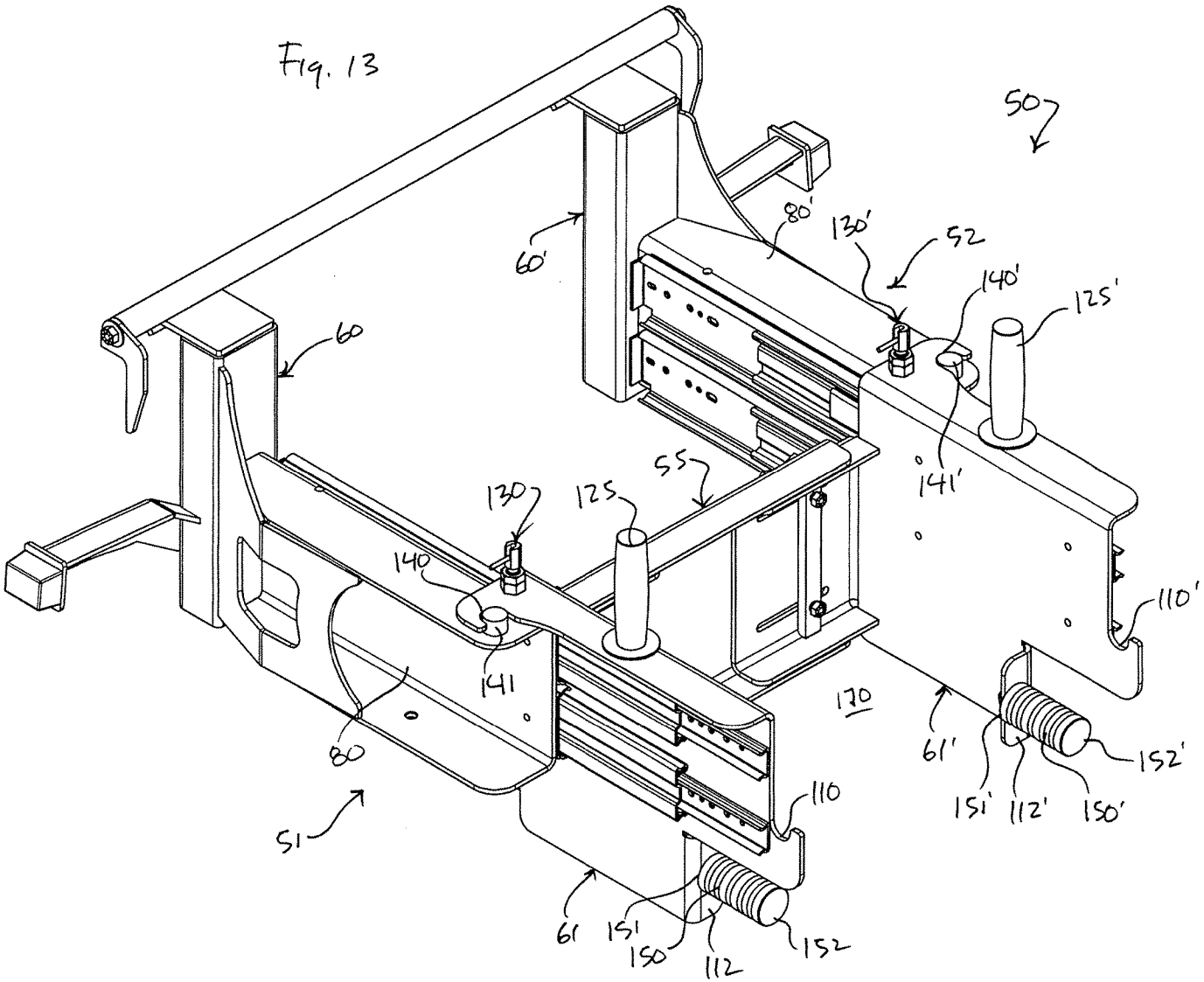
FIG. 13 is a view corresponding to that of FIG. 1 illustrating the load-supporting apparatus as it would appear in an extended position, with spacers shown as they would appear in operative positions.
Figure 14:
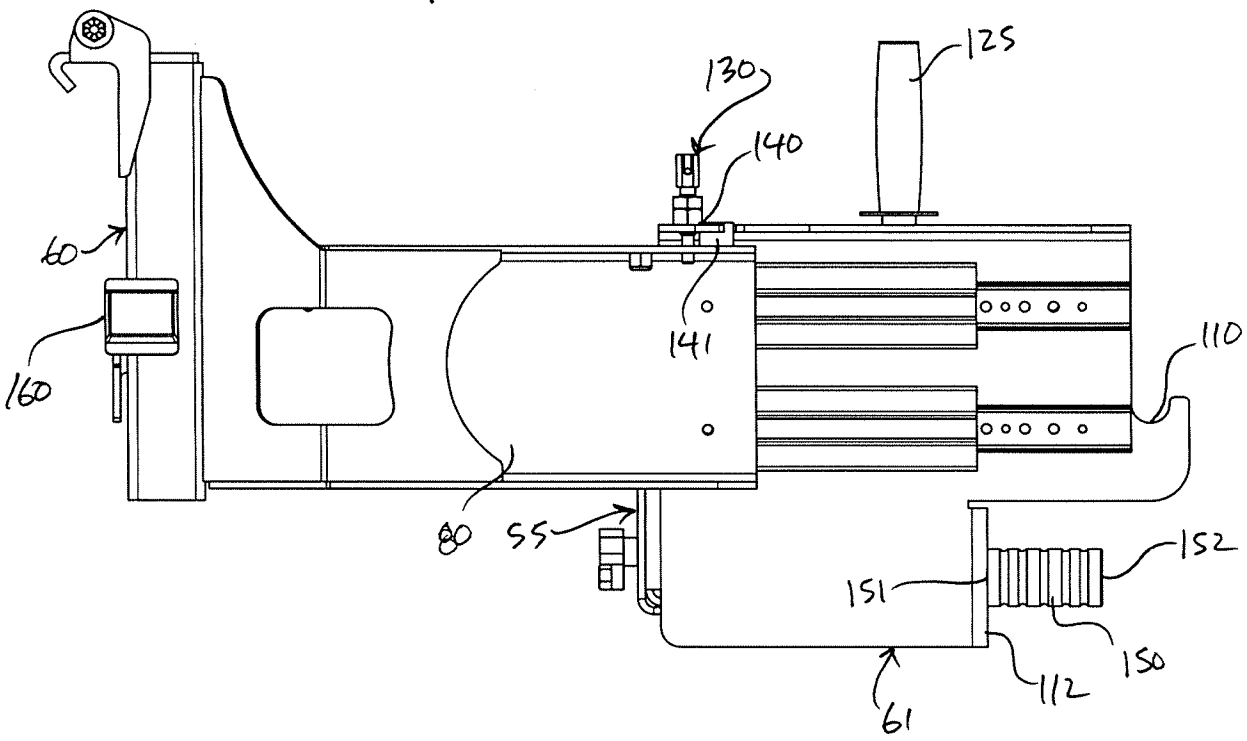
FIG. 14 is a left side elevation view of the embodiment of FIG. 13.
Figure 15:
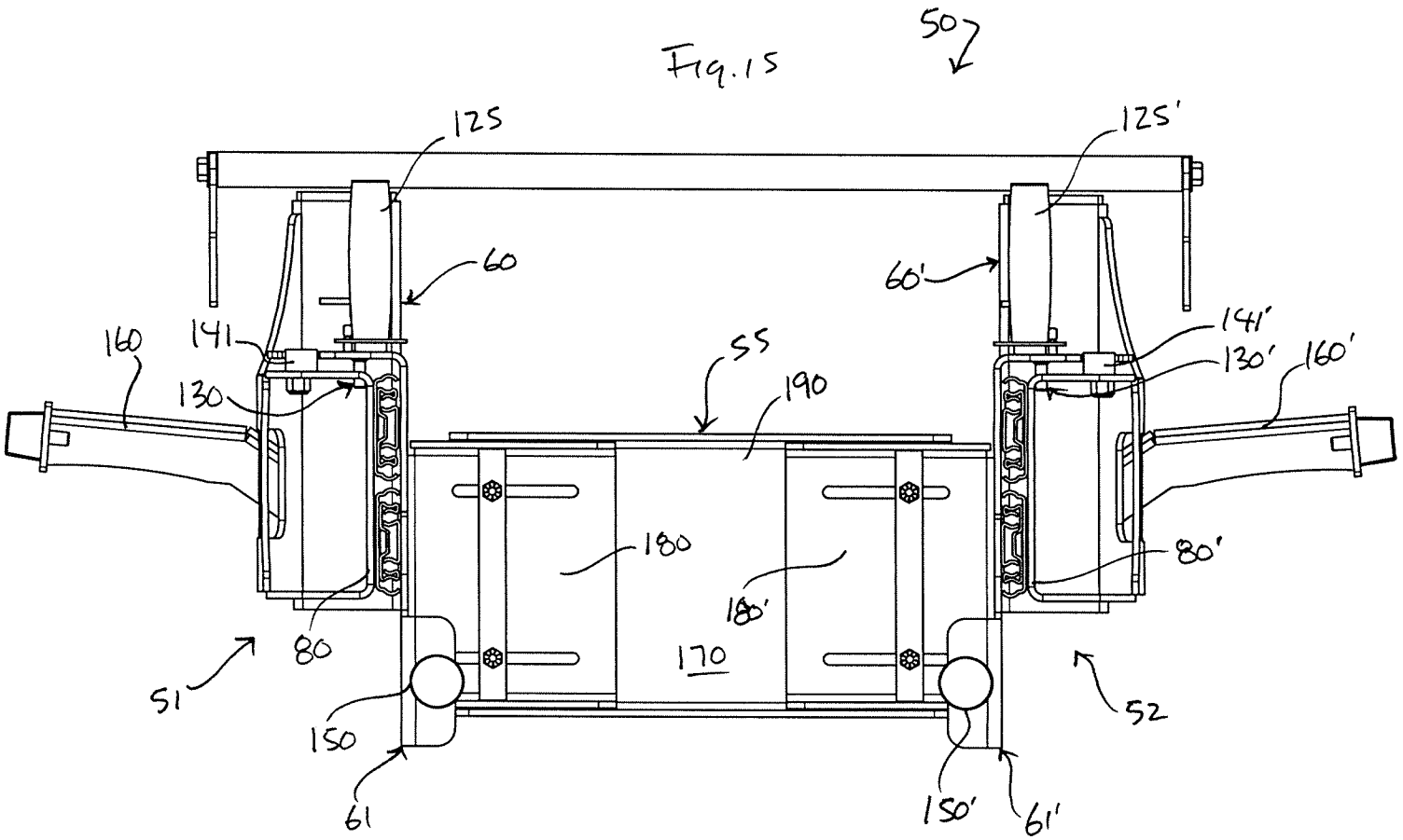
FIG. 15 is a front elevation view of the embodiment of FIG. 13.

Slide 61 is mounted reciprocally to beam 80 of base 60 for movement in reciprocal directions indicated by double arrowed line C in FIGS. 1 and 2 between a retracted position relative to base 60 in FIGS. 1 and 2, and an extended position relative to base 60 in FIGS. 13 and 14. Referring in relevant part to FIGS. 1-6, slide 61 is positioned alongside inner side 85 of beam 80 of base 60 forward of elongate support 70 and extends upright from lower end 103 to upper flange 102, i.e. the upper end of beam 100 of slide 61. Beam 100 and slide 61 concurrently extend upright from lower ends 83 and 103, respectively, to upper ends 82 and 192, respectively, and extend forwardly of elongate member 70 in the same direction, beam 80 from proximal end 88 to distal end 89, and slide from proximal end 108 to distal end 109. Webs 81 and 101 are spaced apart from one another and are juxtaposed side-by side and are upright and parallel relative to each other. Inner side 85 web 81 of beam 80 is parallel to and is spaced apart from and faces inner side 106 of beam 100 of slide 61. Webs 81 and 101 concurrently extend upright from lower ends 83 and 103, respectively, to upper ends 82 and 102, respectively. Upper flange 102 of slide 61 is parallel relative to upper flange 82 of beam 80, and is spaced apart from and above upper flange 82, and extends outwardly and partially over upper flange 82. Upper flange 102, upper flange 82, and lower flange 83 are parallel relative to each other, and are each perpendicular relative to webs 81 and 101.

Slide 61 is mounted reciprocally to beam 80 of base 60 for movement between its retracted position relative to base 60 in FIGS. 1 and 2, and its extended position relative to base 60 in FIGS. 13 and 14, with slide assemblies 120A and 120B. Slide assembly 120A is an upper slide assembly, and slide assembly 120B is under slide assembly 120A and is thus considered to be a lower slide assembly. Slide assemblies 120A and 120B are parallel relative to each other, are identical, and are well-known and readily available drawer slide assemblies each including moving slider 122 mounted slidably to fixed slider 121. Fixed sliders 121 are rigidly affixed, such as by welding or rivets or other fasteners, to inner side 85 of web 81 of beam 80 of base 60. Moving sliders 122 are rigidly affixed such as by welding or rivets or other fasteners, to outer side 106 of web 101 of slide 61. Slide assemblies 120A and 120B are parallel relative to each other, and are positioned between, and are parallel relative to, upper and lower ends 82 and 83 of beam 80 and upper and lower ends 102 and 103 of beam 100. Moving sliders 122 slide into and out of the respective fixed sliders 121, which enables movement of slide 61 from its retracted position relative to base 60 in FIGS. 1 and 2, and its extended position relative to base 60 in FIGS. 13 and 14. Slide 61 is in the retracted position toward base 60 alongside beam 80, when slide assemblies 120A and 120B are in their retracted positions in FIGS. 1 and 2. Slide 61 is in the extended position away from base 60 extending forwardly of distal end 89 of beam 80 of base 60, when slide assemblies 120A and 120B are in their extended positions in FIGS. 1 and 2. A handle 125 is rigidly affixed, such as by welding or a rivet or other fastener, to upper flange 102 of the upper end of slide 61 *b* between proximal end 88 and distal end 89 of slide 61. Handle 125 extends upright from upper end 102 of slide 61, and can be taken up by hand to enable a user to move slide 61 back-and-forth between its retracted and extended positions.

Figure 12:
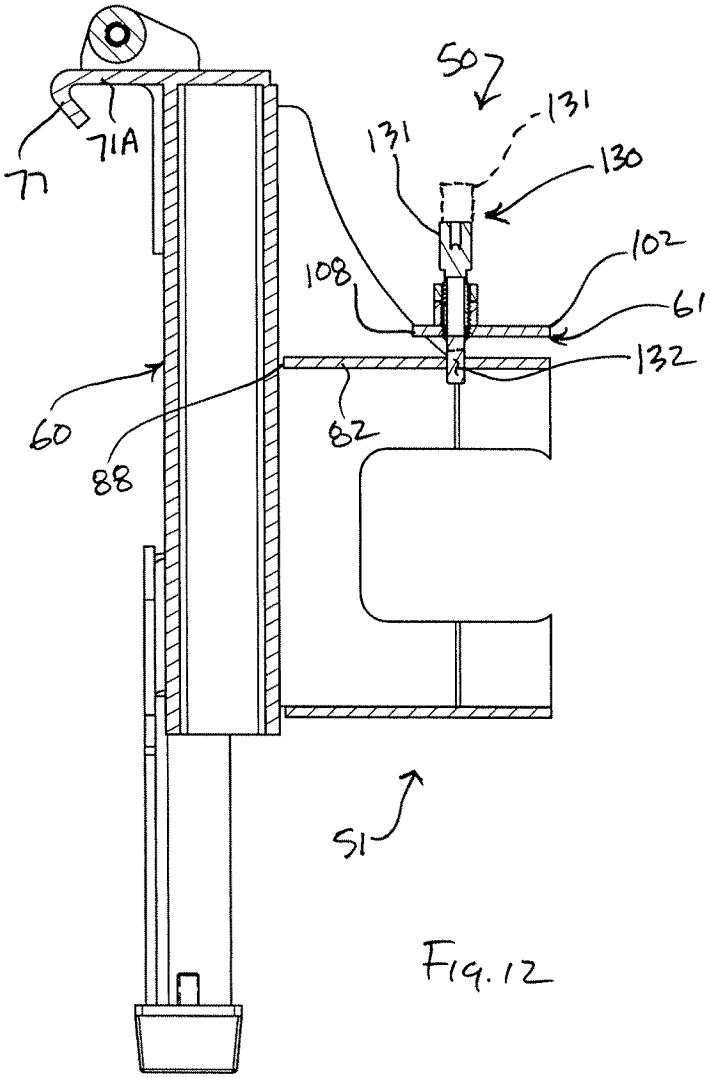
FIG. 12 is a section view taken along line 12-12 of FIG. 1.

Base 60 and slide 61 are fashioned with a lock assembly 130. Slide 61 is disabled from moving between its retracted and extended positions and is locked in its retracted position, when lock assembly 130 is locked in the retracted position of slide 61. Slide 61 is enabled for moving between its retracted and extended positions, when lock assembly 130 is unlocked. Referring to FIG. 12, lock assembly 130 includes a spring-loaded pin 131 mounted to upper flange 102, i.e. the upper end, of slide 61 proximate to proximal end 108, and a hole 132 through upper flange 82, i.e. the upper end, of beam 80 proximate to proximal end 88. In the retracted position of slide 61, spring-loaded pin 131 is registered with hole 132, and slide 61 is disabled from moving between its retracted and extended position when spring-loaded pin 131 is in its locked or extended position extending downwardly through hole 132 locking slide 61 to beam 100 of base 60. To unlock spring-loaded pin 131 when slide 61 is in its retracted position for unlocking slide 61 from beam 100 of base 60, a user need only take up pin 131 by hand and forcibly pull it upwardly to the dotted line position in FIG. 12 so as to withdraw spring-loaded pin 131 from hole 132. Slide 61 is then enabled for moving between its retracted and extended positions, when lock assembly 130 is unlocked, i.e. when spring-loaded pin is pulled upwardly to its dotted line position in FIG. 12 withdrawn from hole 132. After unlocking lock assembly 130 and moving slide forwardly toward its extended position and out of its retracted position misaligning spring-loaded pin 131 from hole 132, spring-loaded pin 131 can be released, enabling it to snap downwardly against upper flange 82, i.e. the upper end of beam 80. Spring-loaded pin 131 slides across upper flange 82 between hole 132 and distal end 89 (not shown in FIG. 12) in its unlocked position, when slide 61 is moved back-and-forth between its retracted and extended positions, and snaps into and through hole 132 in the retracted position of slide 61 when spring-loaded pin 131 registers with hole 132 transitioning lock assembly 130 from its unlocked position to its locked position disabling slide 61 from moving between its retracted and extended positions. The process for unlocking and locking the lock assembly 130 is repeated as needed during the use of load-supporting apparatus.

Figure 4:
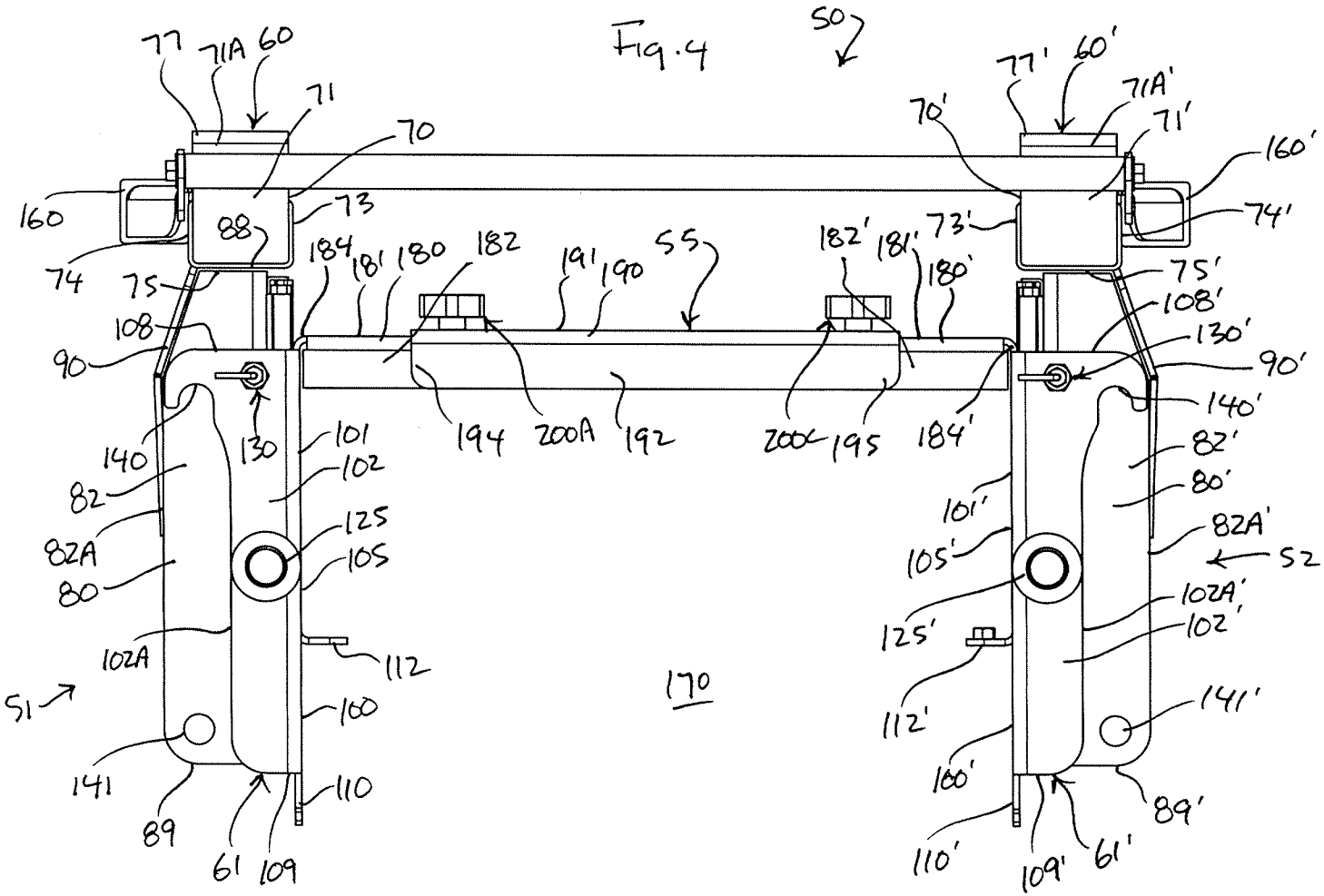
FIG. 4 is a top plan view of the embodiment of FIG. 1.

In FIGS. 1, 2, and 4, hook 140 is carried by base 60, and lug 141 is carried by slide 61. In FIG. 13, hook 140 engages lug 141 when slide 61 is in the extended position, disabling slide 61 from moving beyond the extended position thereby preventing fixed and moving slides 121 and 122 from detaching from one another. Hook 140 is formed in upper flange 102, i.e. the upper end of slide 61, proximate to proximal end 108, and extends outwardly and hooks forwardly in alignment with lug 141, which extends upwardly from upper flange 82, i.e. the upper end of beam 80, outboard of upper flange 102 of slide 61 proximate to distal end 89. In FIGS. 1, 2 and 4, hook 140 is registered with, or is otherwise aligned with, lug 141. In FIG. 13, hook 140 hooks onto and engages lug 141 when slide 61 is in the extended position, disabling slide 61 from moving beyond the extended position thereby preventing fixed and moving slides 121 and 122 from detaching from one another. Although hook 140 is carried by base 60, and lug 141 is carried by slide 61, this arrangement can be reversed in an alternate embodiment. Moreover, hook 140 is an illustrative a stop element, and lug 141 is an illustrative complemental stop element. Other forms of stop element and complemental stop element pairs can be used without departing from the invention, such as complementing abutments, hooks, or that like that interact with one another when slide 61 is in the extended position for disabling slide 61 from moving beyond the extended position.

Figure 3:
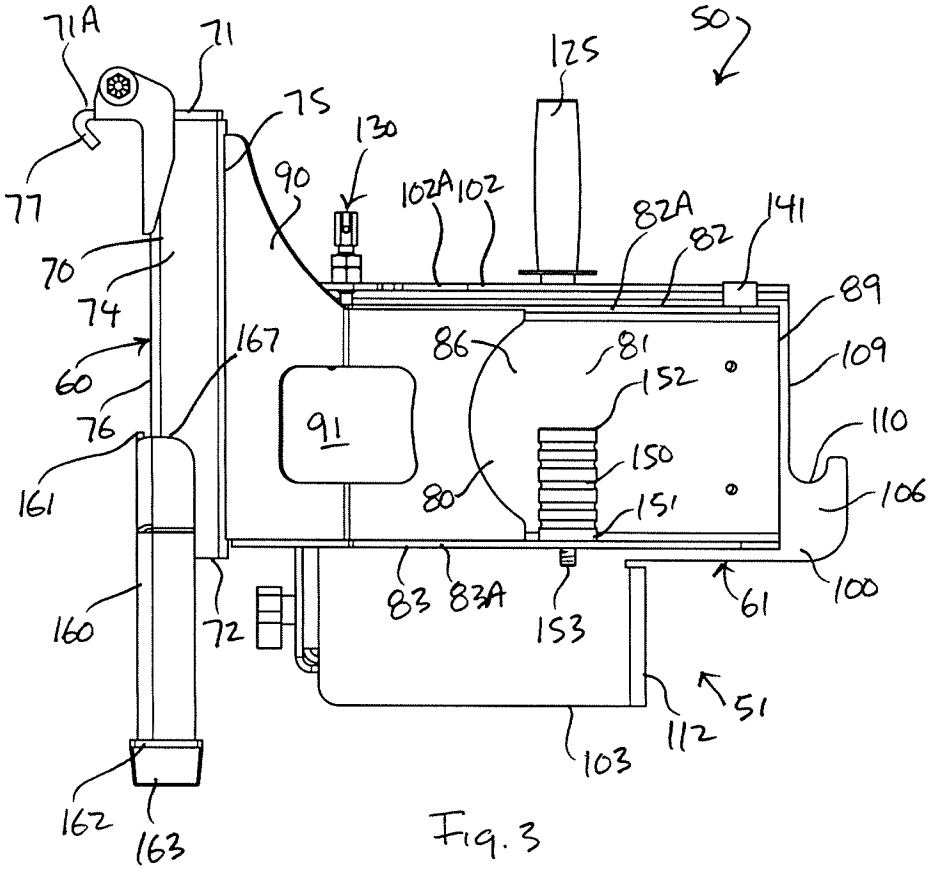
FIG. 3 is a right side elevation view of the embodiment of FIG. 1, the opposite left side elevation being the same thereof.

In FIG. 3, a spacer 150, a cylindrical body of steel, aluminum or other metal or metal composite having inherently rugged, impact resistant, strong, and rigid material characteristics, has proximal end 151, distal end 152, and an engagement element in the form of a threaded shank 153 that depends downwardly from lower end 152. In FIG. 13, there is a threaded opening 155 through lower flange 83, i.e. the lower end of beam 80 of base 60, between proximal end 88 and distal end 89 of beam 80 of base 60, and in FIG. 1 there is threaded opening 156 through abutment 112. Threaded openings 155 and 156 are complemental engagement elements that each complement and can threadably releasably engage threaded shank 153. Spacer 150 is in a stowage position in FIGS. 2, 3, and 5 releasably attached to lower flange 83, i.e. the lower end of beam 80 of base 60, when threaded shank 153 is threadably engaged to threaded opening 155 releasably engaging threaded shank 153 to threaded opening 155 thereby releasably engaging spacer 150 to base 60. Proximal end 151 of spacer 150 is positioned against lower flange 83, spacer 150 extends upwardly toward upper flange 82 from proximal end 151 against lower flange 83 to distal end 152, and is positioned between upper flange 82 and lower flange 3 in the stowage position of spacer 150 when threaded shank 153 is threadably engaged to threaded opening 155. Proximal end 151 of spacer 150 is positioned against lower flange 83, spacer 150 extends upwardly toward upper flange 82 from proximal end 151 against lower flange 83 to distal end 152, and is positioned between upper flange 82 and lower flange 3 in the stowage position of spacer 150 when threaded shank 153 is threadably engaged to threaded opening 155.

Proximal end 151 of spacer 150 is positioned against abutment 112, and spacer 150 extends forwardly horizontally from abutment 112 from proximal end 151 against abutment 112 to distal end 152 in the operative position of spacer 150 when threaded shank 153 is threadably engaged to threaded opening 156. Distal end 152 of spacer 150 is an extended contact point spaced forwardly from the contact point defined by abutment 112 that engages and stabilizes a load carried by load-supporting apparatus 50.

Figure 9:
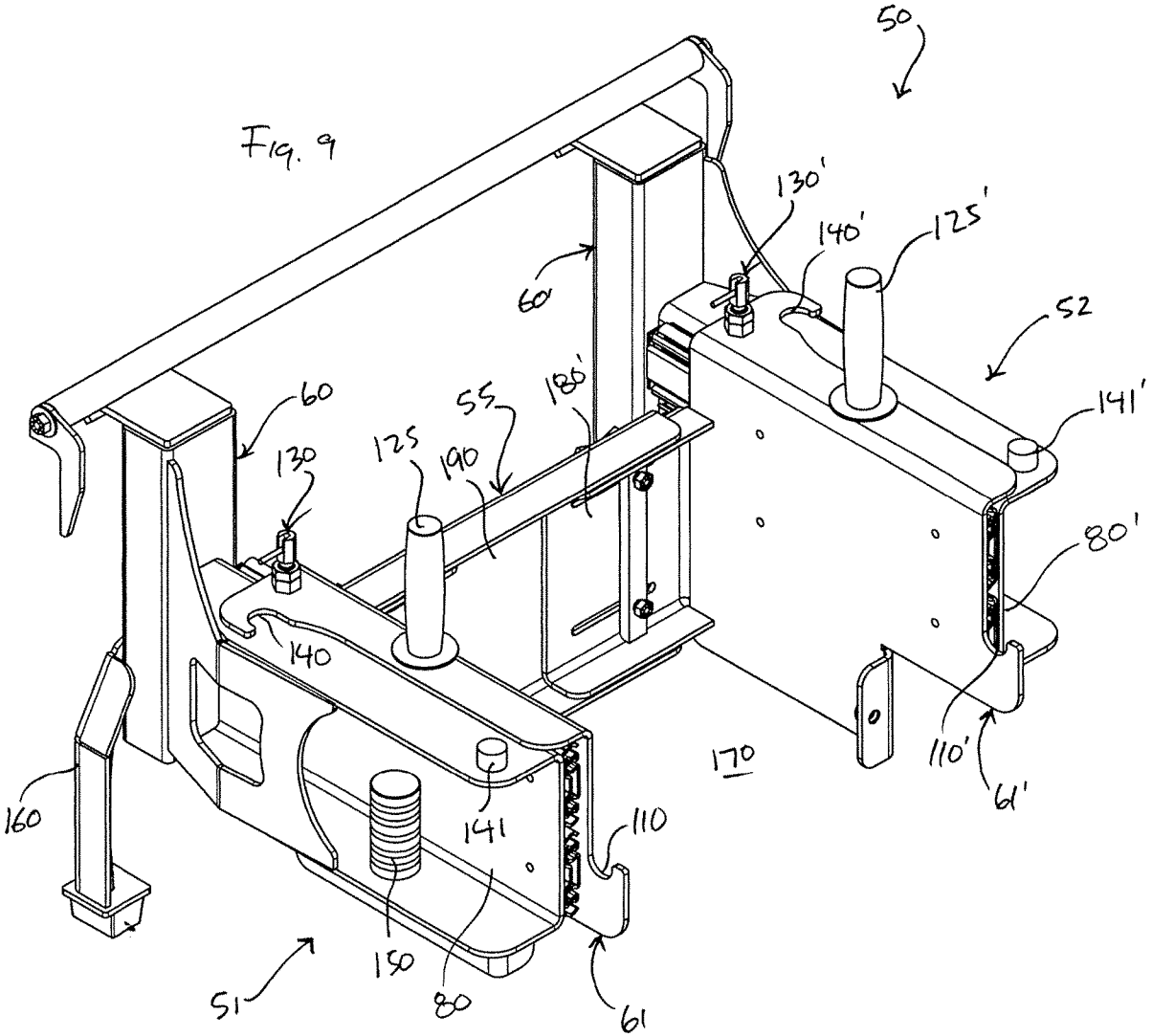
FIG. 9 is view similar to that of FIG. 1 illustrating a right-side brace as it would appear in a lowered position.
Figure 10:
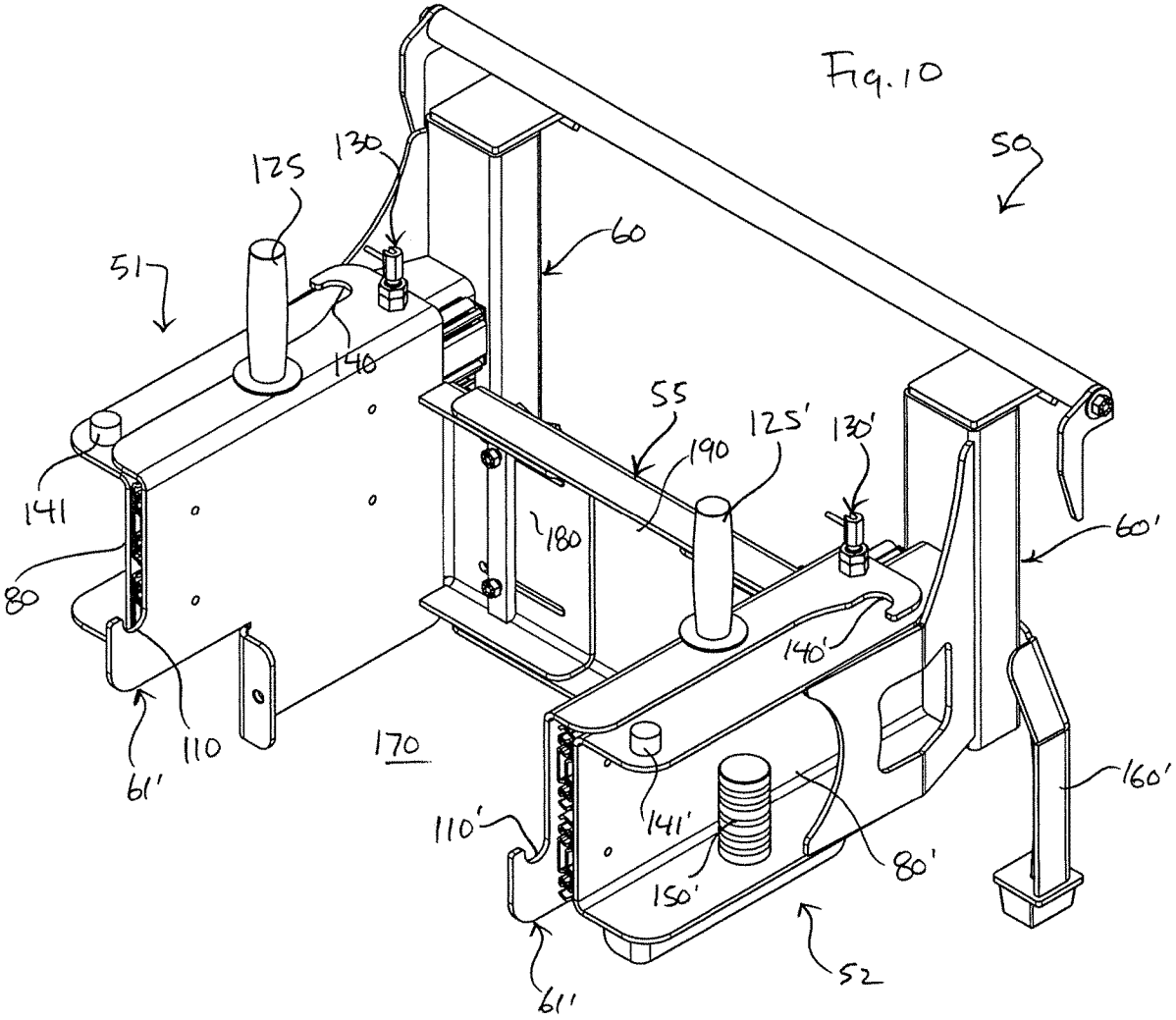
FIG. 10 is a view similar to that of FIG. 1 illustrating a left-side brace as it would appear in a lowered position.
Figure 11:
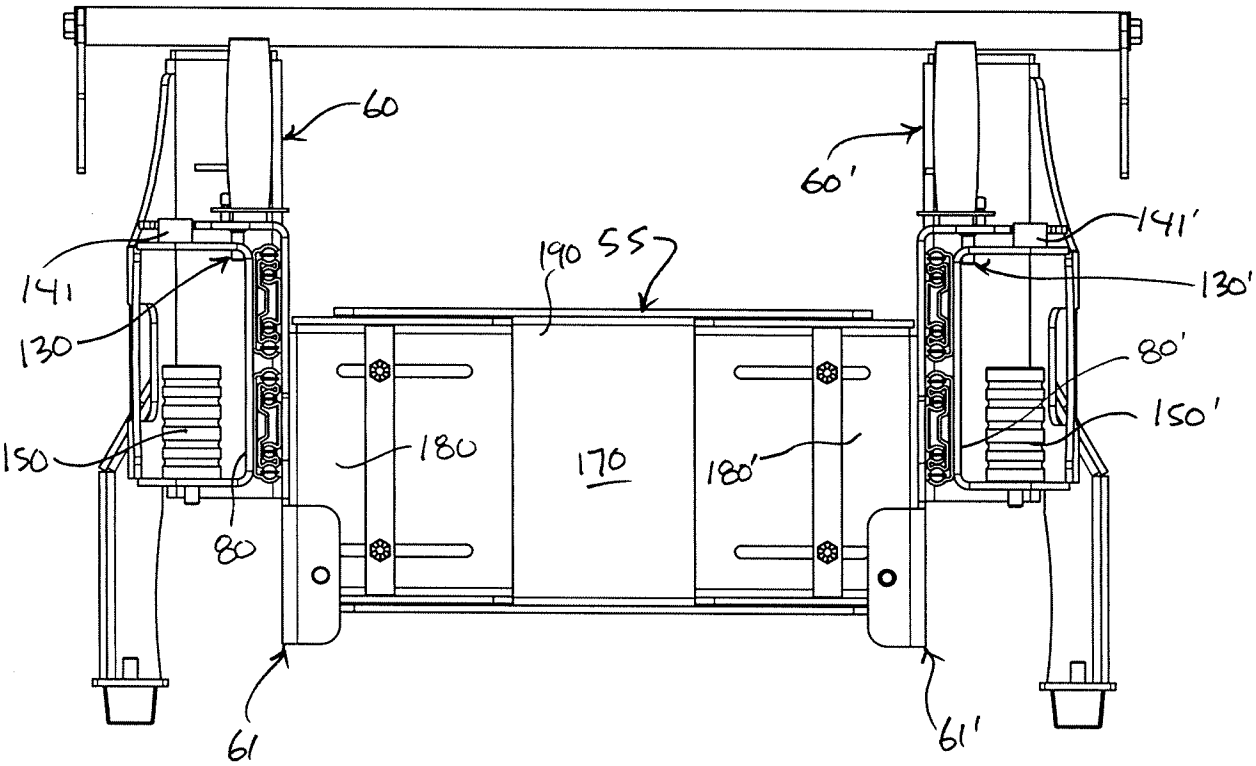
FIG. 11 is a front elevation view of the embodiment of FIGS. 9 and 10.

Referring to FIGS. 2, 3, 5, and 6 in relevant part, support assembly 51 further includes an elongate brace 160 including inner or proximal end 161 and an opposed outer or distal end 162 formed with an attached foot 163 of rubber. Proximal end 161 is mounted pivotally to back 76 of elongate member 70 with a pivot pin 165 in FIG. 6, which enables brace 160 to pivot at proximal end 161 of brace 160 between a lowered position in FIGS. 2, 3, 5 and 6, and a raised position in FIGS. 13, 14, and 15. Brace 160 depends downwardly from base 60 under lower end 72 of elongate member 70 and under beams 80 and 100 to distal end 162 and foot 163, when brace 160 is in the lowered position. Brace 160 extends laterally outward from outer side 74 of elongate member 70 of base 60 to distal end 162 and foot 163, when brace 160 is in the raised position. Brace 160 has a stop 167 proximate to proximal end 161 that confronts outer side 74 of elongate support 70. In FIGS. 2 and 9, stop 167 contacts outer side 74 of elongate support 70, when brace 160 is in its lowered position disabling brace 160 from moving past its lowered position. In FIG. 13, stop 168 contacts outer side 74 of elongate support 70, when brace 160 is in its raised position disabling brace 160 from moving past its raised position.

Support assembly 51 further includes a link 180, which forms part of linkage assembly 55. Link 180 is a structural element that is capable of withstanding load primarily by resisting bending, and is fashioned steel, aluminum or other metal or metal composite having inherently rugged, impact resistant, strong, and rigid material characteristics. Referring in relevant part to FIGS. 1 and 4-6, link 180 is a C-beam in this example having a C-shaped cross-section, and includes a vertical web 181, horizontal upper flange 182 that defines an upper end of link 180, horizontal lower flange 183 that defines a lower end of link 180, proximal end 184, and distal end 185. Link 180 extends vertically upright from lower flange 183 to upper flange 182, proximal end 184 is affixed rigidly via welding to inner side 105 of web 101, and link 180 extends perpendicularly inwardly from inner side 105 of web 101 to distal end 185. Upper and lower flanges 182 and 183 extend in a forward direction in this example. Upper and lower elongate slots 187 and 188 are formed through web 181. Upper and lower elongate slots 187 and 188 are between proximal and distal ends 184 and 185, are between upper and lower flanges 182 and 183, are horizontal, and are parallel relative to each other and relative to upper and lower flanges 182 and 183.

Support assemblies 51 and 52 oppose one another and are axially spaced apart and form a receiving area 170 between slides 61 and 61', and are coupled together via linkage assembly 55 for relative movement of support assemblies 51 and 52 in reciprocal directions relative to one another as indicated by the double arrowed line B in FIGS. 1 and 2 away from one another in FIGS. 1-6 widening receiving area 170 and toward one another in FIGS. 9-11, 13, and 15 narrowing receiving area 170. Linkage assembly includes link 180 of support assembly 51, link 180' of support assembly 52, and link 190. Like links 180 and 180', link 190 is a structural element that is capable of withstanding load primarily by resisting bending, and is fashioned steel, aluminum or other metal or metal composite having inherently rugged, impact resistant, strong, and rigid material characteristics. Referring in relevant part to FIGS. 1 and 4-6, link 190 is a C-beam in this example, corresponding to the shapes of links 180 and 180', having a C-shaped cross-section, and includes a vertical web 191, horizontal upper flange 192 that defines an upper end of link 190, horizontal lower flange 193 that defines a lower end of link 190, and opposed ends 194 and 15.

Figure 5:
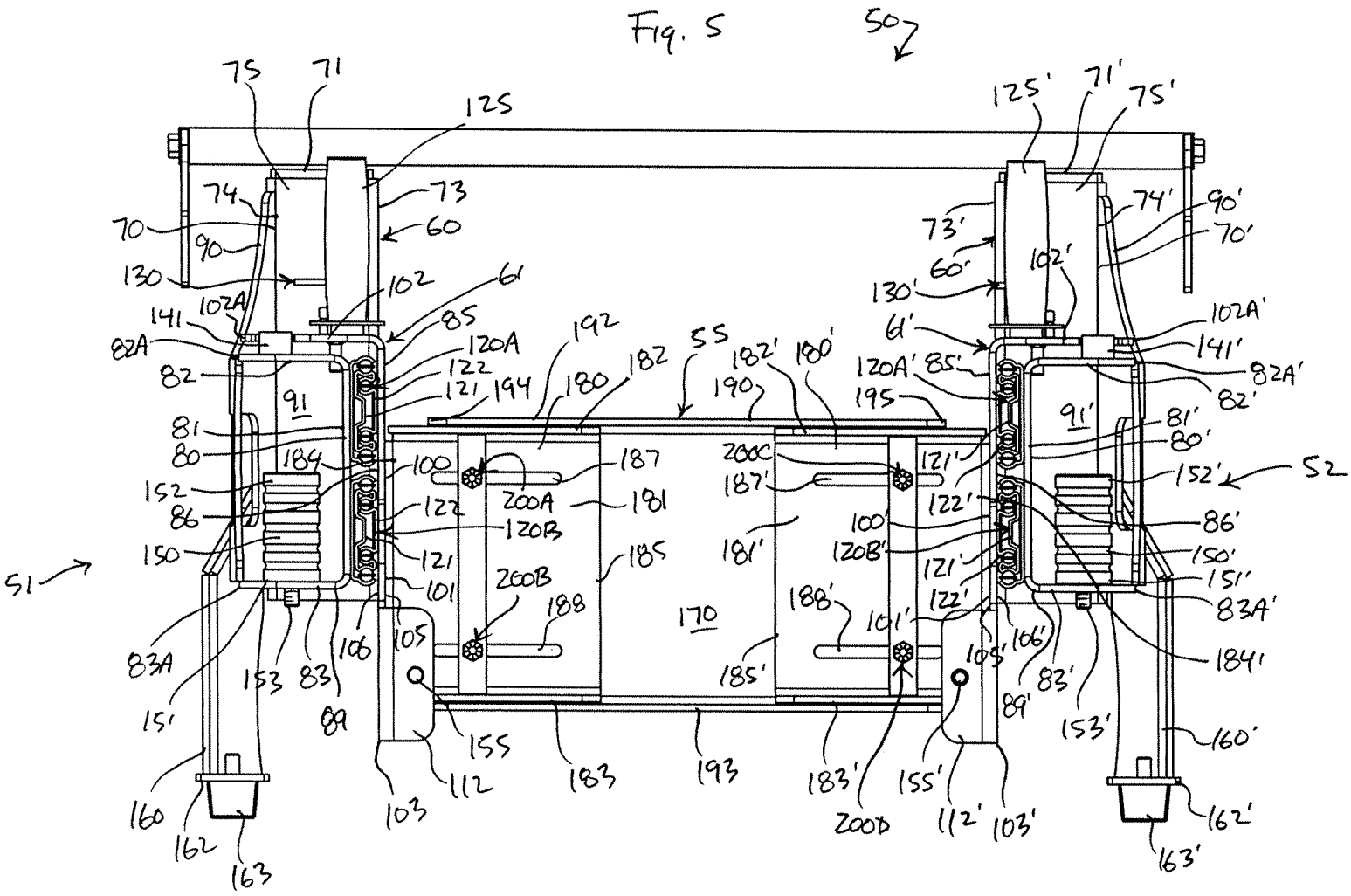
FIG. 5 is a front elevation view of the embodiment of FIG. 1.
Figure 6:
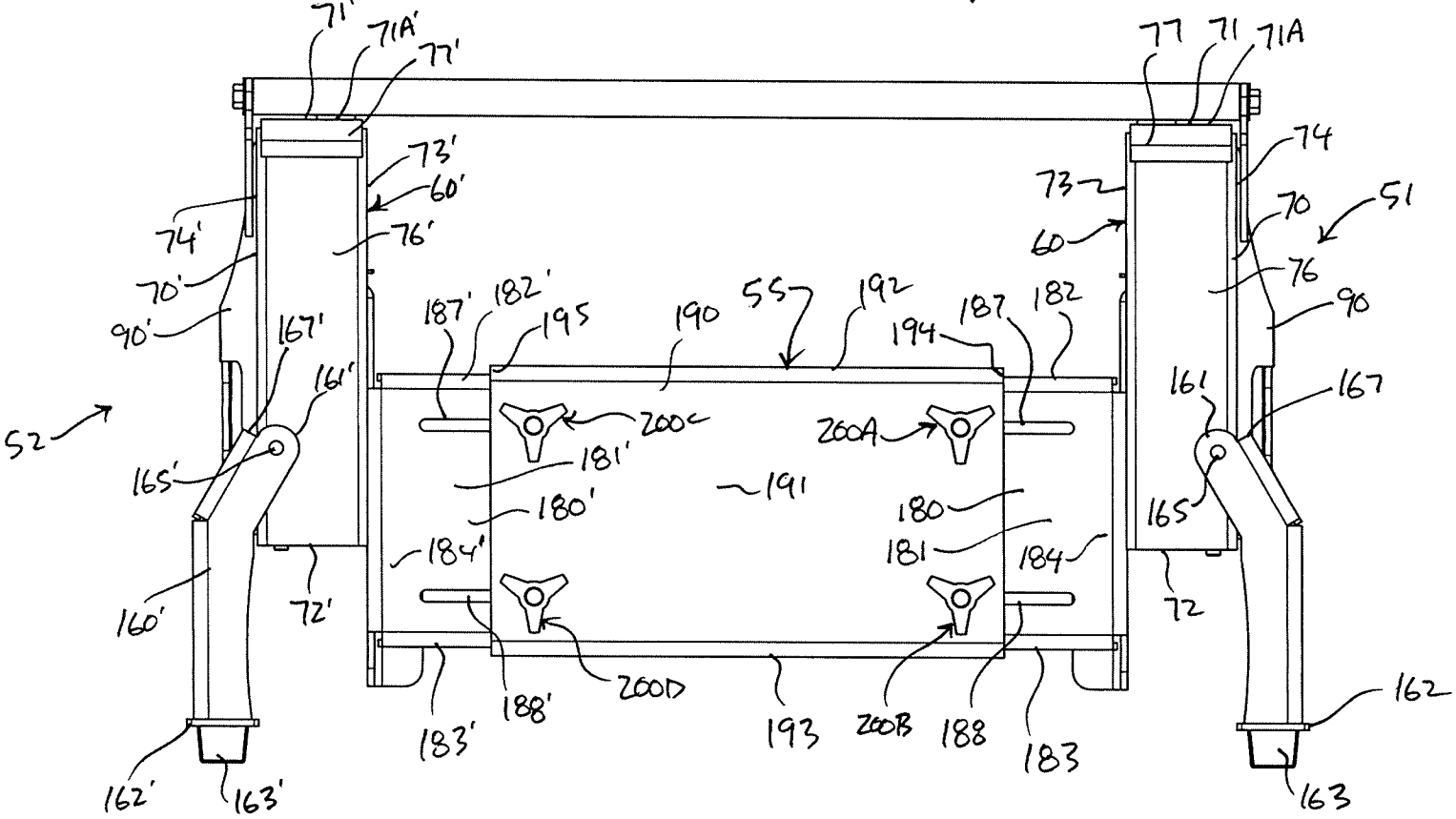
FIG. 6 is a rear elevation view of the embodiment of FIG. 1.
Figure 7:
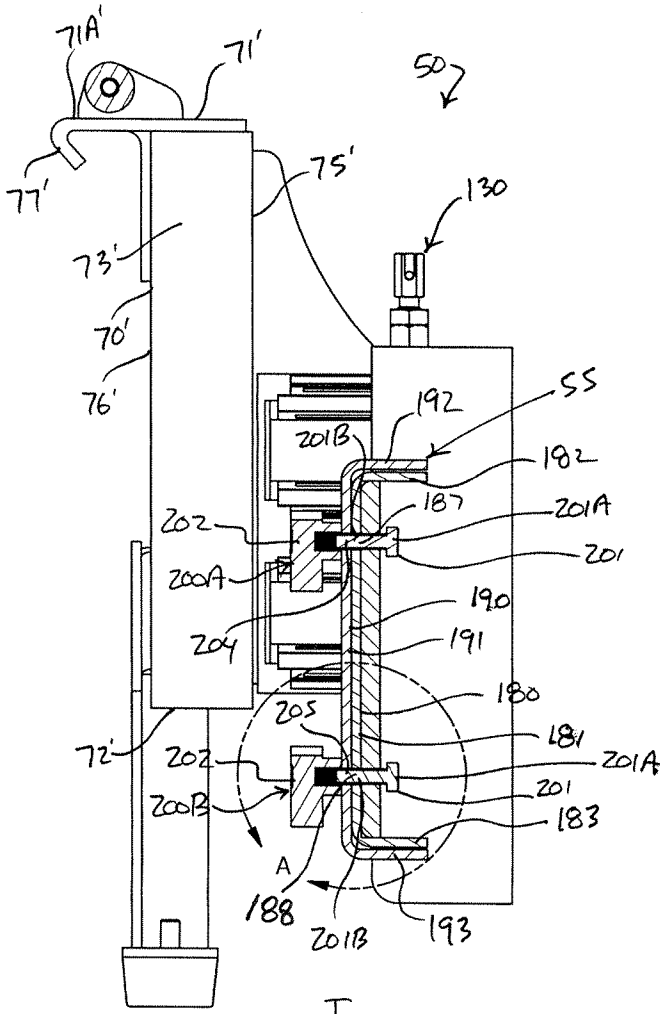
FIG. 7 is a section view taken along line 7-7 of FIG. 1.

Link 190 extends vertically upright from lower flange 193 to upper flange 192, and upper and lower flanges 192 and 193 extend forwardly in the same direction as upper and lower flanges 182 and 183 of link 180 and upper and lower flanges 182' and 183' of link 180'. In FIGS. 5, 6, and 7, link 190 is positioned between links 180 and 180', distal end 185 of link 189 is nested into the front of end 194 of link 190, end 194 of link 190 is connected to distal end 185 of link 180, end 185' of link 180' is nested into the front of end 195 of link 190, and end 195 of link 190 is connected to distal end 185' of link 180'.

Figure 8:
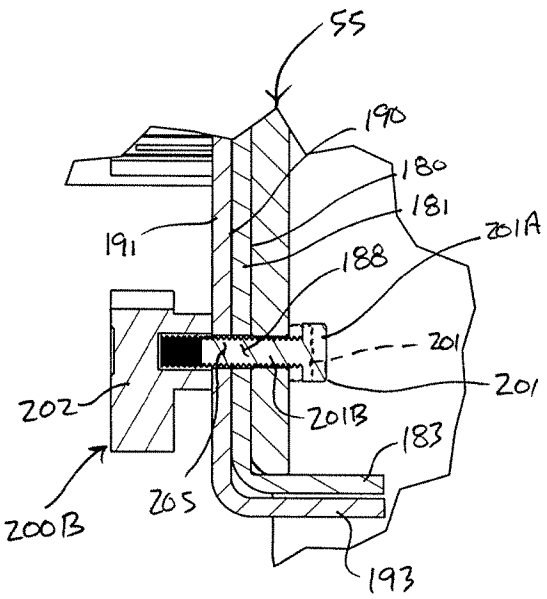
FIG. 8 is an enlarged view circled area A of FIG. 7.

End 194 is connected to distal end 185 of link 180 with upper and lower fastener assemblies 200A and 200B, and end 195 is connected to distal end 185' of link 180 with upper and lower fastener assemblies 200C and 200D. Fastener assemblies 200 are identical. Referring to FIG. 7 and also FIG. 8, which is an enlarged view of circled area A of FIG. 7, each fastener assembly 200 includes a bolt 201, having head 201A and threaded shank 201B, and a knob 202. In FIG. 7, threaded shank 201B of bolt 201 of upper fastener assembly 200A concurrently extends through upper hole 204, through web 191 of link 190 proximate to end 194 adjacent to upper flange 192, and upper elongate slot 187, through web 181 of link 180, and is threaded into knob 202 positioned along the back side of link 190. In FIGS. 7 and 8, bolt 201 of the lower fastener assembly 200B concurrently extends through lower hole 205, through web 191 of link 190 proximate to end 194 adjacent to lower flange 193, and lower elongate slot 188, through web 181 of link 180, and is threaded into knob 202 positioned along the back side of link 190. Bolt 201 and knob 202 of upper and lower knob assemblies 200A and 200B can be concurrently tightened when knobs 202 are rotated in a tightening direction to clamp end 194 of link 190 and distal end 185 of link 180 between head 201A and knob 202, indicated by the position of knob 202 against the back side of link 190 and the dotted line position of head 201A in FIG. 8 against the front side of link 180 in conjunction with lower knob assembly 200B, and can be concurrently loosened when knobs 202 are rotated in the opposite loosening direction to unclamp end 194 of link 190 from distal end 185 of link 180 between head 201A and knob 202. End 194 of link 190 and distal end 185 of link 180 are clamped and locked together and restrained from reciprocal movement relative to each other, when upper and lower fastener assemblies 200A and 200B are in their tightened or clamped positions. End 194 of link 190 and distal end 185 of link 180 are unclamped and unlocked from one another and enabled for reciprocal movement relative to each other, when upper and lower fastener assemblies 200A and 200B are in their loosened or unclamped positions. Upper and lower fastener assemblies 200A and 200B are lock assemblies which are locked in the tightened or clamped positions of upper and lower fastener assemblies 200A and 200B, and are unlocked in the loosened or unclamped positions of upper and lower fastener assemblies 200A and 200B. Bolts 201 of upper and lower fastener assemblies 200A and 200B are free to slide longitudinally through the respective slots 187 and 188 when upper and lower fastener assemblies 200A and 200B are unlocked unclamping distal end 185 of link 180 from end 194 of link 190, which enables relative reciprocal movement of link 190 relative to link 180 for, in turn, enabling relative reciprocal movement of support assembly 51 in reciprocal directions toward and away from support assembly 52. Bolts 201 of upper and lower fastener assemblies 200A and 200B are restrained from sliding longitudinally through the respective slots 187 and 188 when upper and lower fastener assemblies 200A and 200B are locked unclamping distal end 185 of link 180 from end 194 of link 190, which disables relative reciprocal movement of link 190 relative to link 180 for, in turn, disabling relative reciprocal movement of support assembly 51 in reciprocal directions toward and away from support assembly 52. The foregoing discussion of upper and lower fastener assemblies 200A and 200B in conjunction with end 194 of link 190 and distal end 185 of link 180, including upper and lower elongate slots 187 and 188, applies in every respect to upper and lower fastener assemblies 200C and 200D in conjunction with end 195 of link 190 and distal end 185' of link 180', including upper and lower elongate slots 187' and 188'.

The application of upper and lower fastener assemblies 200A and 200B to end 194 of link 190 and distal end 185 of link 180 and the interaction of upper and lower fastener assemblies 200A and 200B with upper and lower elongate slots 187 and 188 all cooperate together to form a linkage lock assembly, whereby links 180 and 190 are enabled for moving toward and away from one another when the linkage lock assembly is unlocked, i.e. when upper and lower fastener assemblies 200A and 200B are unlocked, and links 180 and 190 are disabled from moving toward and away from one another when the linkage lock assembly is locked, i.e. when upper and lower fastener assemblies 200A and 200B are locked.

The application of upper and lower fastener assemblies 200C and 200D to end 195 of link 190 and distal end 185' of link 185' and the interaction of upper and lower fastener assemblies 200C and 200D with upper and lower elongate slots 187' and 188' all cooperate together to form another linkage lock assembly, whereby links 180' and 190 are enabled for moving toward and away from one another when this other linkage lock assembly is unlocked, i.e. when upper and lower fastener assemblies 200C and 200D are unlocked, and links 180' and 190 are disabled from moving toward and away from one another when the this other linkage lock assembly is locked, i.e. when upper and lower fastener assemblies 200C and 200D are locked. The linkage lock assembly between link 180 and link 190 can be used independently of, or concurrently with, the linkage lock assembly between link 180' and link 190.

And so linkage assembly 55 is capable of being unlocked and locked, in which support assemblies 51 and 52 are disabled from moving toward and away from one another via linkage assembly 55, when linkage assembly 55 is locked, and support assemblies 51 and 52 are enabled for moving toward and away from one another via linkage assembly 55, when linkage assembly 55 is unlocked. Linkage assembly 55 is unlocked when the linkage lock assembly associated with distal end 185 of link 180 and end 194 of link 190 is unlocked, when linkage lock assembly associated with distal end 185' of link 180' and end 195 of link 190 is unlocked, and when the linkage lock assembly associated with distal end 185 of link 180 and end 194 of link 190 and linkage lock assembly associated with distal end 185' of link 180' and end 195 of link 190 are concurrently unlocked. Support assemblies 51 and 52 are enabled for movement in reciprocal directions toward and away from one another when linkage assembly 55 is unlocked. Linkage assembly 55 is locked when the linkage lock assembly associated with distal end 185 of link 180 and end 194 of link 190 and linkage lock assembly associated with distal end 185' of link 180' and end 195 of link 190 are concurrently locked. Support assemblies 51 and 52 are disabled from movement in reciprocal directions toward and away from one another when linkage assembly 55 is locked.

In sum, load-supporting apparatus 50 includes support assemblies 51 and 52. Support assembly 51 includes base 60, and slide 61 mounted to base 60 for movement between retracted and extended position relative to base 60, and slide 61 includes upper and lower ends 102 and 103 that extend from a proximal end 108 toward elongate support 70 of base 60 to cradle 110 at distal end 109 away from elongate support 70 of base 60, inner and outer sides 105 and 106, and abutment 112 proximate to lower end 103 between proximal and distal ends 108 and 109 that extends inwardly from inner side 105 into receiving area 170. Identically, support assembly 52 includes base 60', and slide 61' mounted to base 60' for movement between retracted and extended position relative to base 60', and slide 61' includes upper and lower ends 102' and 103' that extend from a proximal end 108' toward elongate support 70' of base 60' to cradle 110' at distal end 109' away from elongate support 70' of base 60', inner and outer sides 105' and 106', and abutment 112' proximate to lower end 103' between proximal and distal ends 108' and 109' that extends inwardly from inner side 105' into receiving area 170. Support assemblies 51 and 52 extend in the same direction, are axially spaced apart, and form receiving area 170 between inner side 105 of slide 61 and inner side 105' of slide 61' forward of linkage assembly 55. Linkage assembly 55 couples slide 61 of support assembly 51 to slide 61' of support assembly 52, which couples support assembly 51 to support assembly 52. Linkage assembly 55 is adjustable in length as disclosed for enabling adjustment of support assemblies 51 and 52 toward and away from one another. Abutments 112 and 112' of support assemblies 51 and 52 define contact points that engage and stabilize a load relative to support assemblies 51 and 52, when the load is between slides 61 and 61' and supported by slides 61 and 61', such as when trunnions of a load are pivotally supported by the respective cradles 112 and 112' of slides 61 and 61'. Bases 60 and 60' of support assemblies 51 and 52 include hooks 77 and 77', respectively. Bases 60 and 60' are concurrently mountable releasably to a lift, by suspending load-supporting apparatus 50 from a the lift with hooks 77 and 77', operable for raising and lowering load-supporting apparatus 50 between raised and lowered positions. Support assemblies 51 and 52 are enabled for adjustment toward and away from one another via linkage assembly 55, when bases 60 and 60' are concurrently mounted releasably to the lift, namely, when bases 60 and 60' are concurrently suspended from the lift with hooks 77 and 77', which is explained more fully below. Support assembly 51 includes lock assembly 130, and support assembly 52 includes lock assembly 130'. Slide 61 of support assembly 51 is disabled from moving between retracted and extended positions, when lock assembly 130 is locked, and slide 61 of support assembly 51 is enabled for moving between the retracted and extended positions, when lock assembly 130 is unlocked. Slide 61' of support assembly 52 is disabled from moving between retracted and extended positions, when lock assembly 130' is locked, and slide 61' of support assembly 52 is enabled for moving between retracted and extended positions, when lock assembly 130' is unlocked. Handle 125 extends upright from upper end 102 of slide 61 of support assembly 51, and handle 125' extends upright from upper end 102' of slide 61' of support assembly 52. Handles 125 and 125' can be selectively taken up by hand for moving slides 61 and 61' of support assemblies 51 and 52 between the retracted and extended positions. Slides 61 and 61' are parallel to each other, including axially spaced slides 61 and 61'. Support assembly 51 further includes spacer 150, an engagement element carried by spacer 150, and first and second complemental engagement elements carried by the slide 61 and the base 60, respectively, wherein spacer 150 is in a stowage position releasably attached the base 60, when the engagement element of spacer 150 is releasably engaged to the first complemental engagement element, and spacer 150 is in an operative position releasably attached to slide 61 extending forwardly from abutment 112, when the engagement element of spacer 150 is releasably engaged to the second complemental engagement element. Support assembly 52 further includes spacer 150', an engagement element carried by spacer 150', and first and second complemental engagement elements carried by the slide 61' and the base 60', respectively, wherein spacer 150' is in a stowage position releasably attached the base 60', when the engagement element of spacer 150' is releasably engaged to the first complemental engagement element, and spacer 150' is in an operative position releasably attached to slide 61' extending forwardly from abutment 112', when the engagement element of spacer 150' is releasably engaged to the second complemental engagement element. Spacers 150 and 150' define extended contact points spaced forwardly from the contact points of the respective abutments 112 and 112' that engage and stabilize the load relative to the first and second support assemblies, when the load is between and is supported by slides 61 and 61', such as when the trunnions of the load are pivotally supported by the respective cradles 112 and 112' of slides 61 and 61'. Linkage assembly 55 incorporates at least one linkage lock assembly. Support assemblies 51 and 52 are enabled for moving toward and away from one another via the linkage assembly 55, when the linkage lock assembly is unlocked, and support assemblies 51 and 52 are disabled from moving toward and away from one another via the linkage assembly 55, when the linkage lock assembly is locked. Support assembly 51 includes stop element 140 and complemental stop element 141, and support assembly 52 includes stop element 140' and complemental stop element 141'. Stop element 140 is carried by base 60, complemental stop element 141 is carried by slide 61, and stop element 140 engages complemental stop element 141 when slide 61 is in the extended position, disabling slide 61 from moving beyond the extended position. Stop element 140' is carried by base 60', complemental stop element 141' is carried by slide 61', and the stop element 140' engages complemental stop element 141' when slide 61' is in the extended position, disabling slide 61' from moving beyond the extended position. Support assemblies 51 and 52 further include braces 160 and 160'. Brace 160 depends downwardly from base 60 to foot 163. Brace 160' depends downwardly from base 60' to foot 163'. The foot 163 of brace 160 and foot 163' of brace 160' engage a base of the lift, when the bases 60 and 60' are mounted to the lift and the load-supporting apparatus 50 is in the lowered position.

Figure 16:
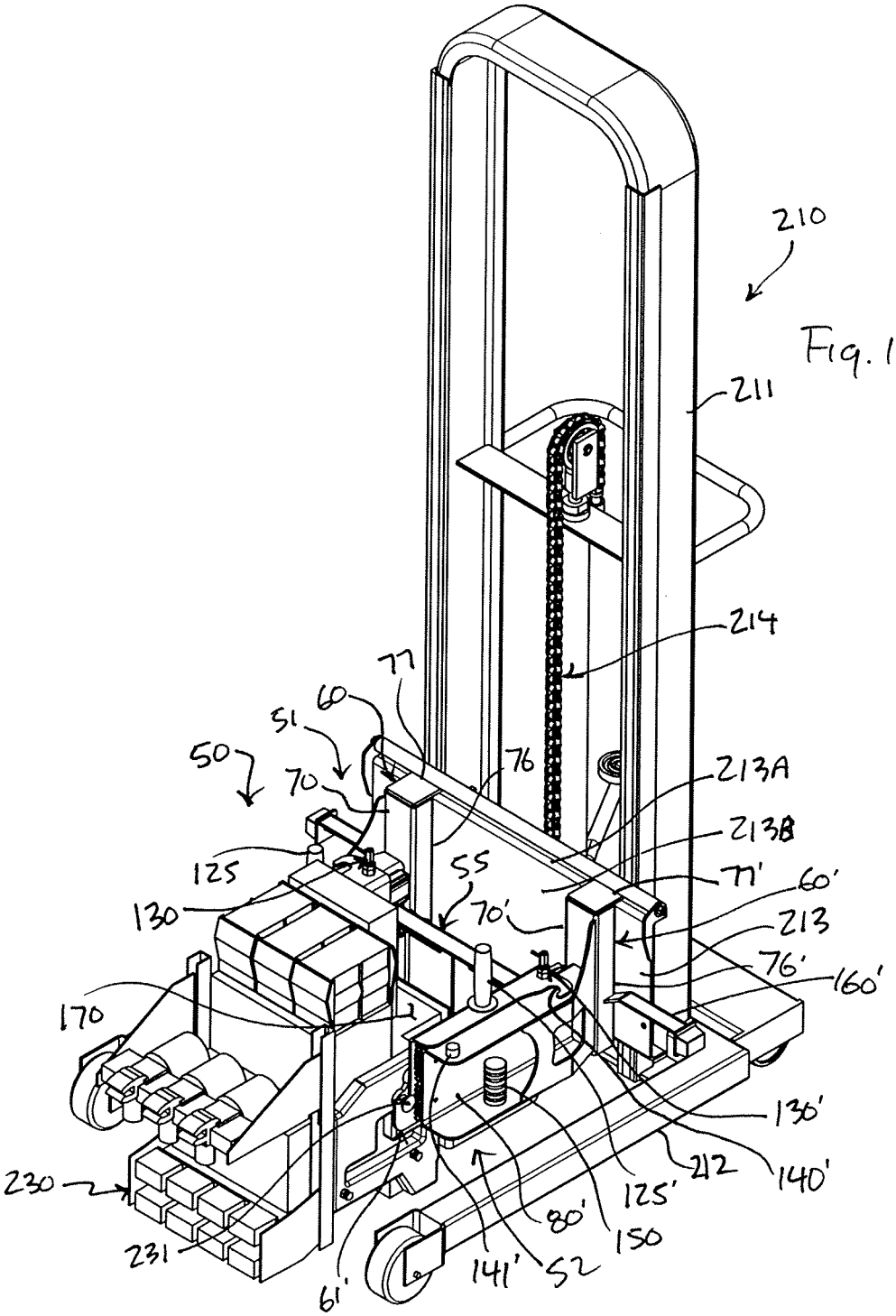
FIG. 16 is a view of the load-supporting apparatus of FIG. 1 mounted to a lift while supporting a breaker, the lift is operable for raising and lowering the load-supporting apparatus for raising and lowering the breaker, and the breaker is shown in a lowered position corresponding to a lowered position of the load-supporting apparatus.
Figure 21:
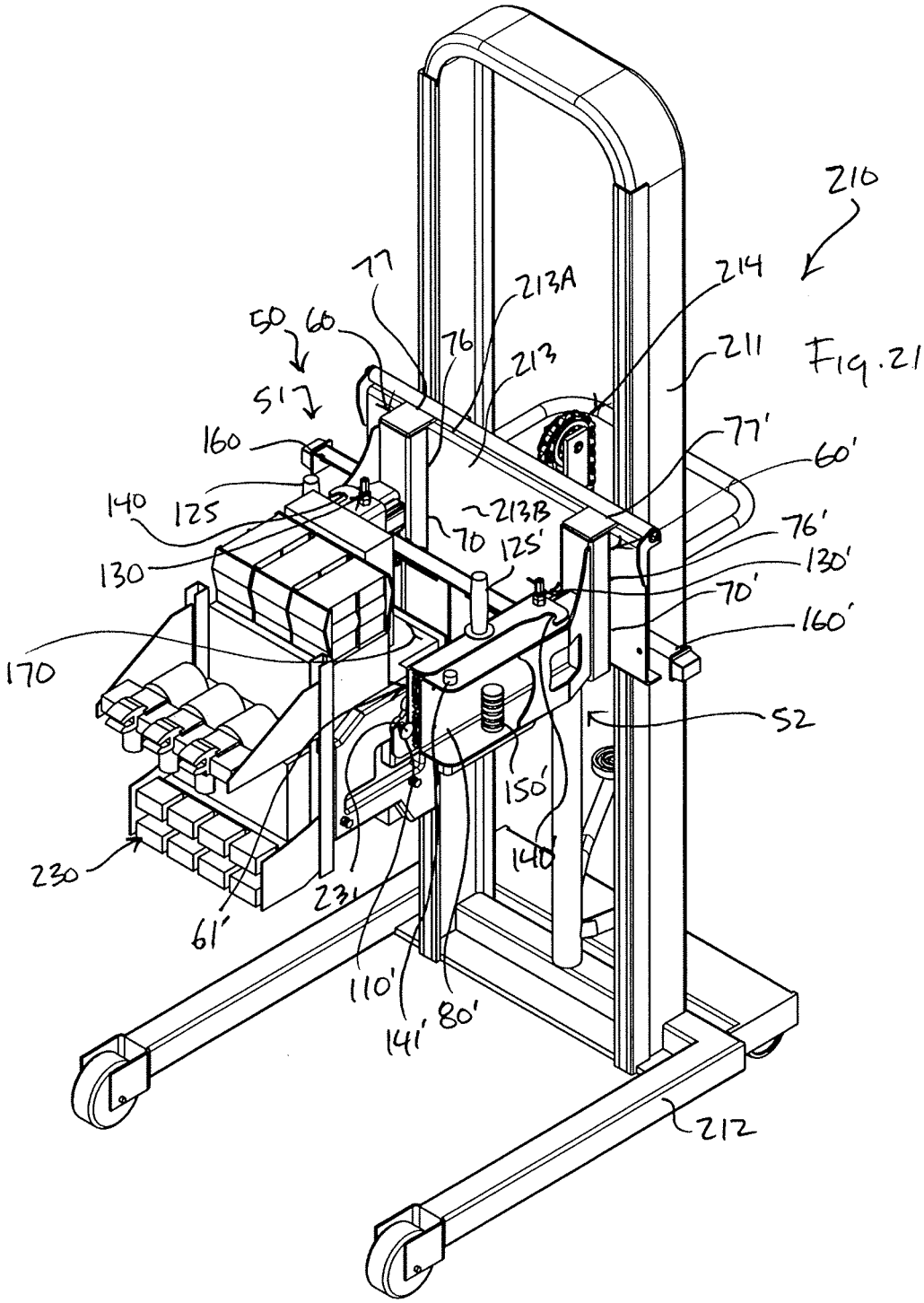
FIG. 21 is a top left perspective view corresponding to FIG. 16 illustrating the breaker in a raised position corresponding to a raised position of the load-supporting apparatus.
Figure 22:
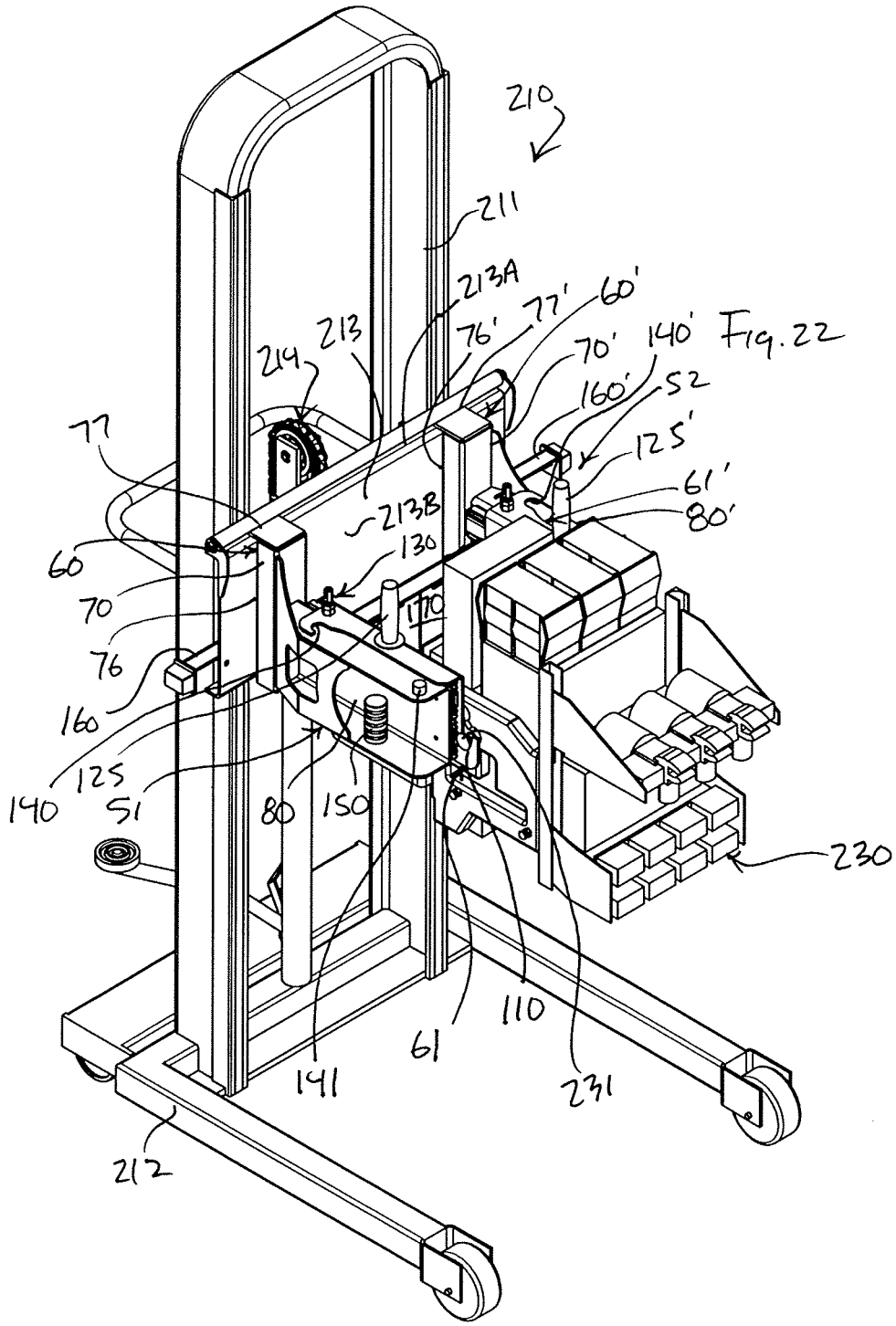
FIG. 22 is a top right perspective view of the embodiment of FIG. 21.
Figure 23:
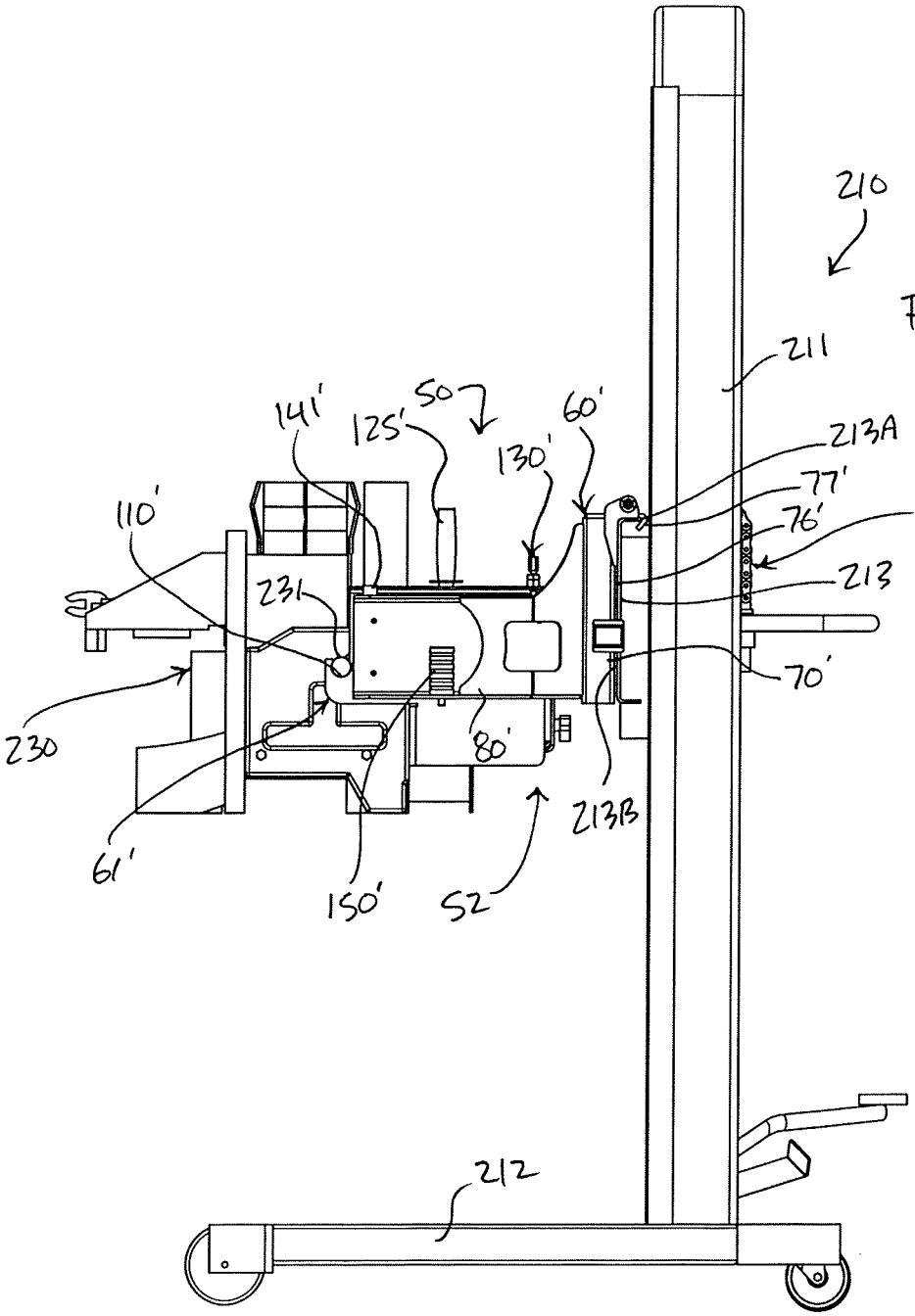
FIG. 23 is a left side elevation view of the embodiment of FIG. 21.
Figure 24:
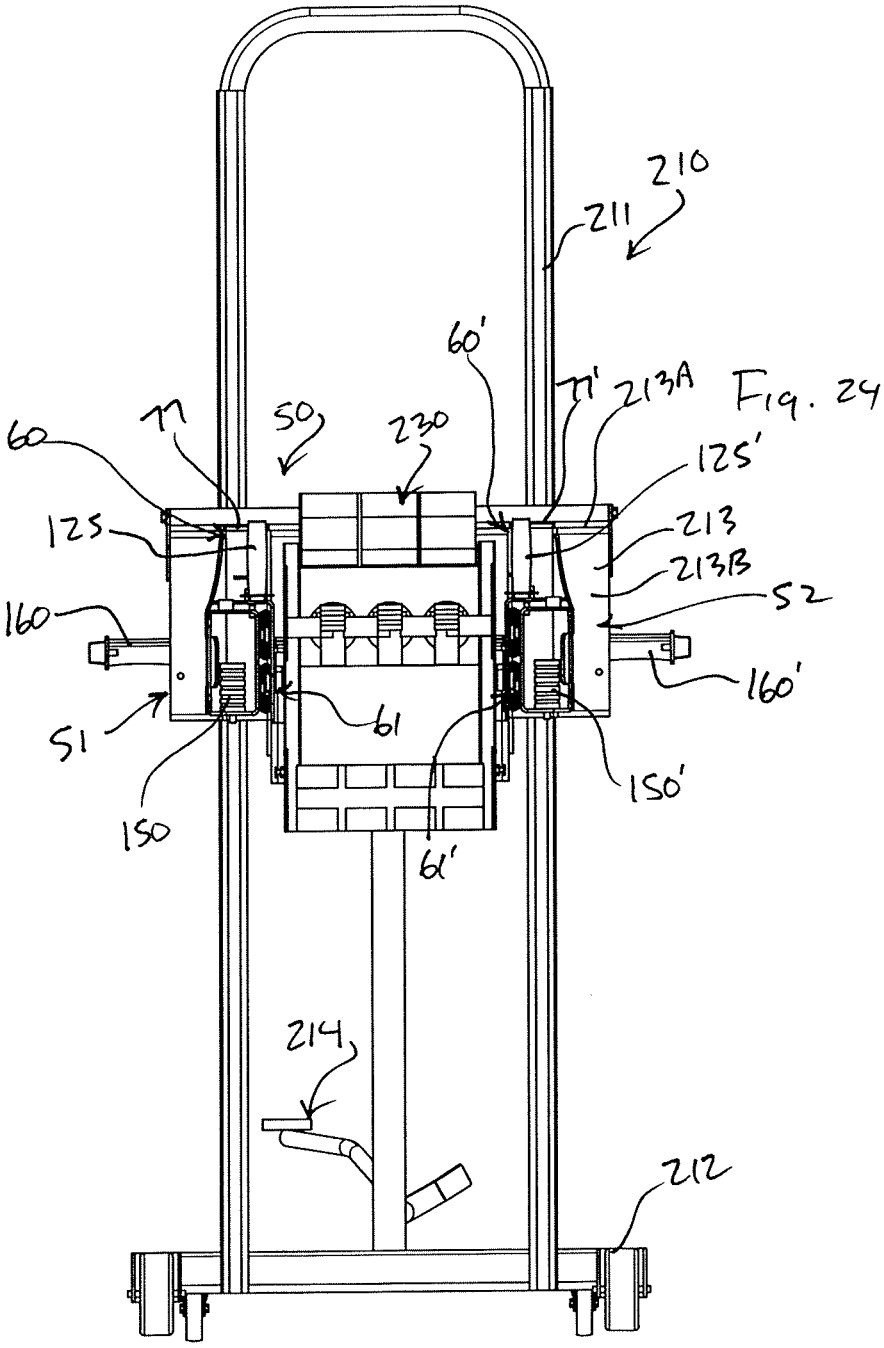
FIG. 24 is a front elevation view of the embodiment of FIG. 21.
Figure 25:
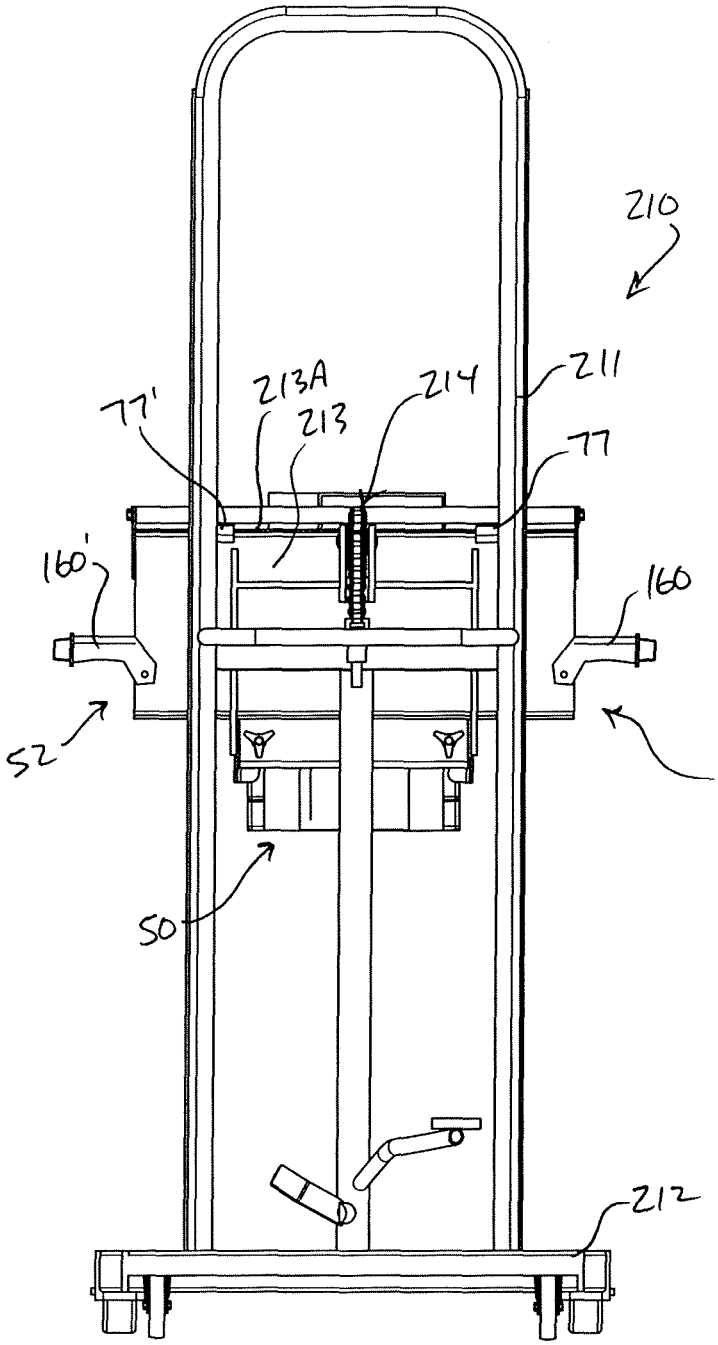
FIG. 25 is a rear elevation view of the embodiment of FIG. 21.

FIG. 16 illustrates a lift 210 including upright mast 211 mounted to a wheeled base 212, and backboard 213 mounted to upright mast 211 for reciprocal movement in lowering and raising/lifting directions between a lowered position in FIG. 16, and a lifting, lifted or raised position in FIG. 21. Lift 210 incorporates drive assembly 214, operative for raising and lowering backboard 213 and for lifting and lowering load-supporting apparatus 50 mounted to backboard 213, namely, suspended from backboard 213. Drive assembly 214 is a conventional manually-operated a pedal-driven drive assembly, and can be a motorized drive assembly in an alternate embodiment. Handle 215 connected to the rear of mast 211 can be taken up by hand by an operator standing to the rear of lift 210 for wheeling lift 210 about. Lift 210 is generally representative of a conventional and well-known lift, further details of which will readily occur to the skilled artisan and will not be discussed in further detail.

FIG. 16 illustrates load-supporting apparatus suspended from backboard 210 with hooks 77 and 77'. In FIG. 16, load-supporting apparatus 50 is upright, hooks 77 and 77' are hooked over upper edge 213A of backboard 213, bases 60 and 60' of support assemblies 51 and 51 depend vertically downwardly along front surface 213B of backboard 213, backs 76 and 76' of elongate supports 70 rest directly against front surface 213B of backboard 213, and the beam assemblies of support assemblies 51 and 52, the beam 80 and slide 61 of support assembly 51 and beam 80' and slide 61' of support assembly 52 concurrently extend horizontally forwardly from bases 60 and 60' relative to front surface 213B of backboard 213 over base 212. Load-supporting apparatus 50 is easily mounted to lift simply by hooking hooks 77 and 77' over upper edge 213A of backboard 213 and allowing backs 76 and 76' of elongate supports 70 and 70 to simply come to rest directly against front surface 213B of backboard 213 supporting the beam and slide assemblies horizontally in front of front face 213B of backboard 213 over base 212 as shown in FIG. 16. Hooks 77 and 77' suspend load-supporting apparatus 50 from backboard 213 without the use of separate tools and without having to modify load-supporting apparatus 50 or lift 210 or backboard 213 and without the need for separate mechanical fasteners, and which allows load-supporting apparatus 50 to be detached from lift 210 simply by taking up load-supporting apparatus 50, such as by hand, and lifting it upwardly and away from backboard 213 unhooking hooks 77 and 77' from upper edge 213A of backboard 213. Hooks 77 and 77' can slide over upper edge 213A of backboard surface 213A of backboard 213, which enables support assemblies 51 and 52 to be slide back and forth toward and away from one another when linkage assembly 55 is unlocked for adjusting receiving area 170 between inner sides 105 and 105' of slides 61 and 61' to corresponding to the load to be supported by load-supporting apparatus 50.

Figure 17:
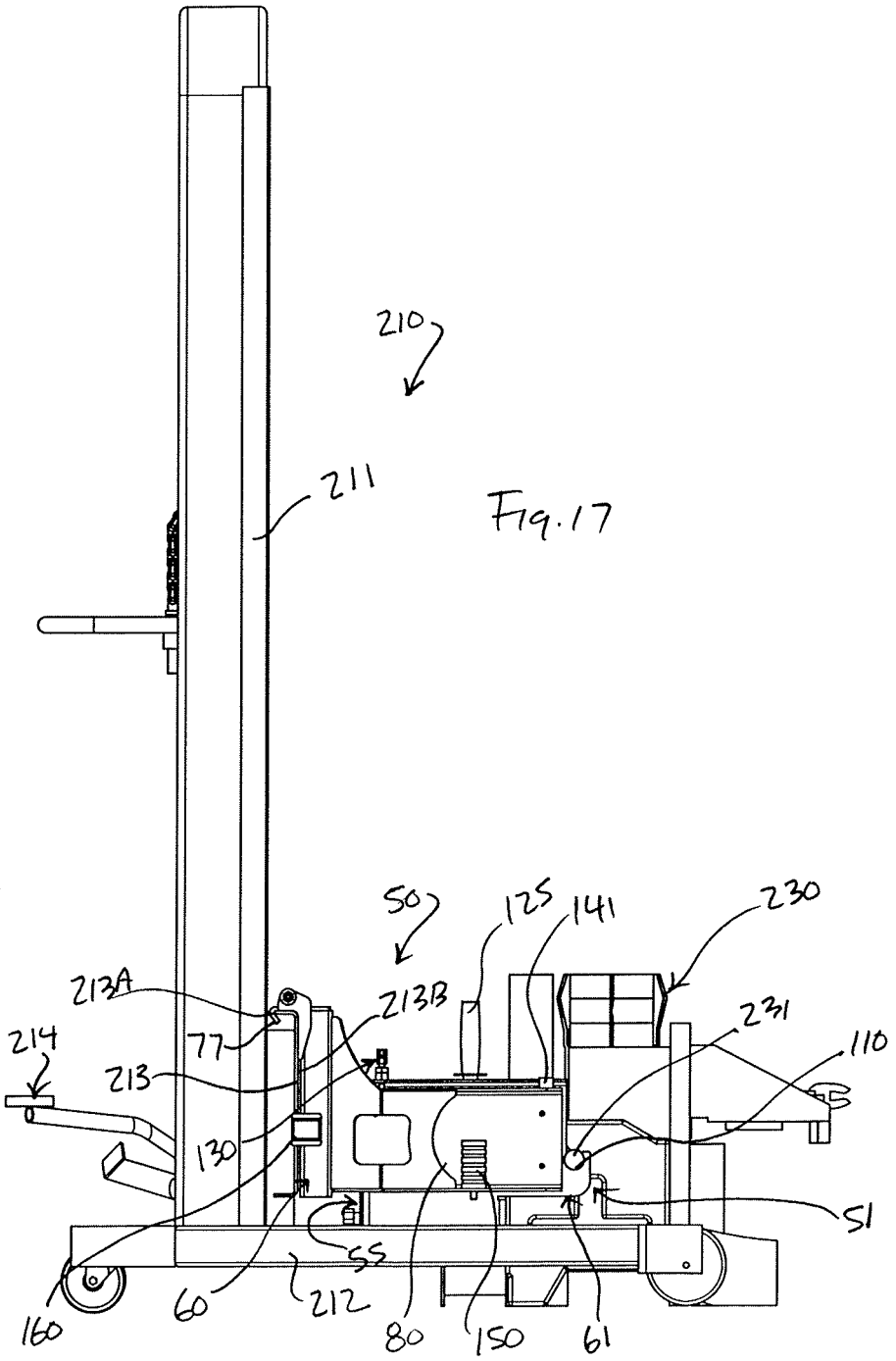
FIG. 17 is a left side elevation view of the embodiment of FIG. 16.
Figure 18:
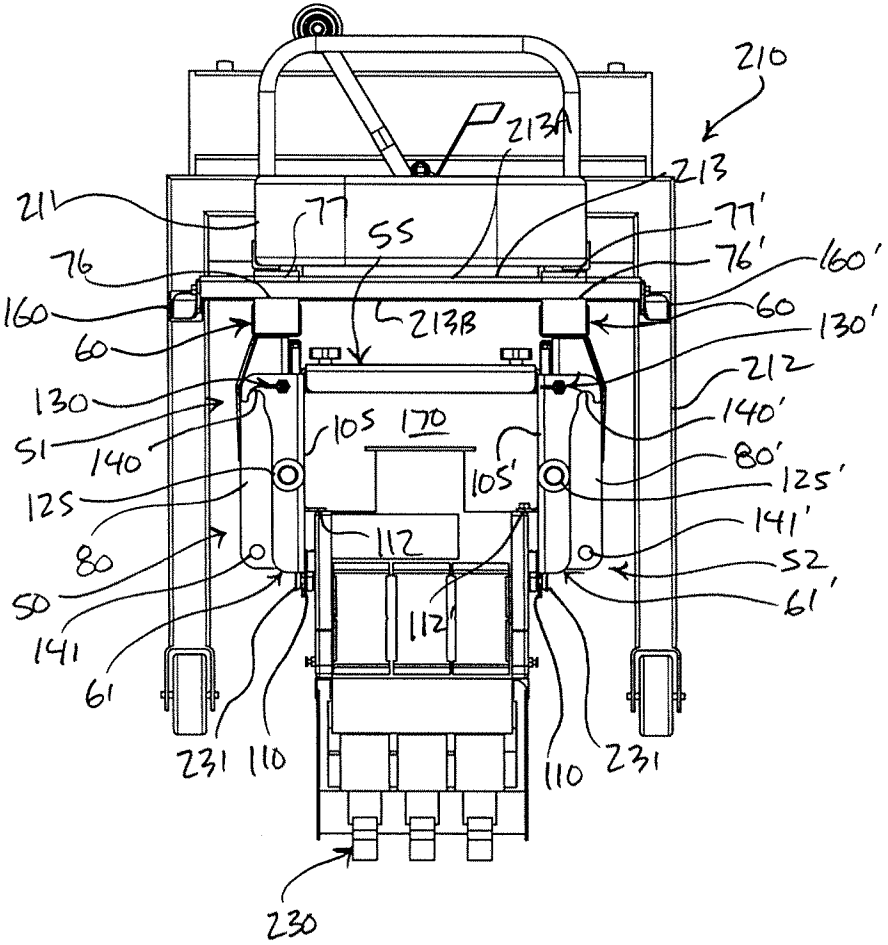
FIG. 18 is a top plan view of the embodiment of FIG. 16.
Figure 19:
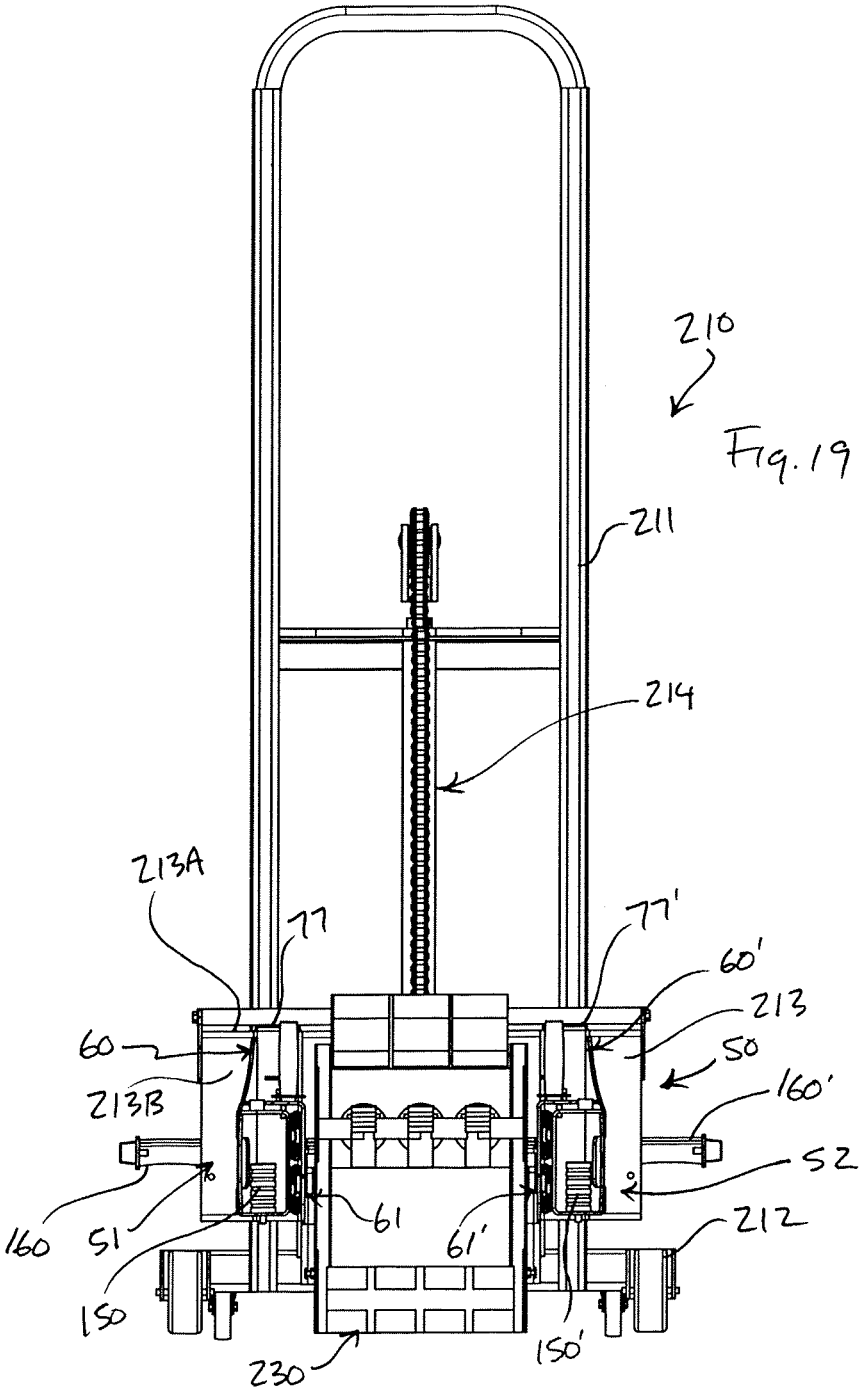
FIG. 19 is a front elevation view of the embodiment of FIG. 16.
Figure 20:
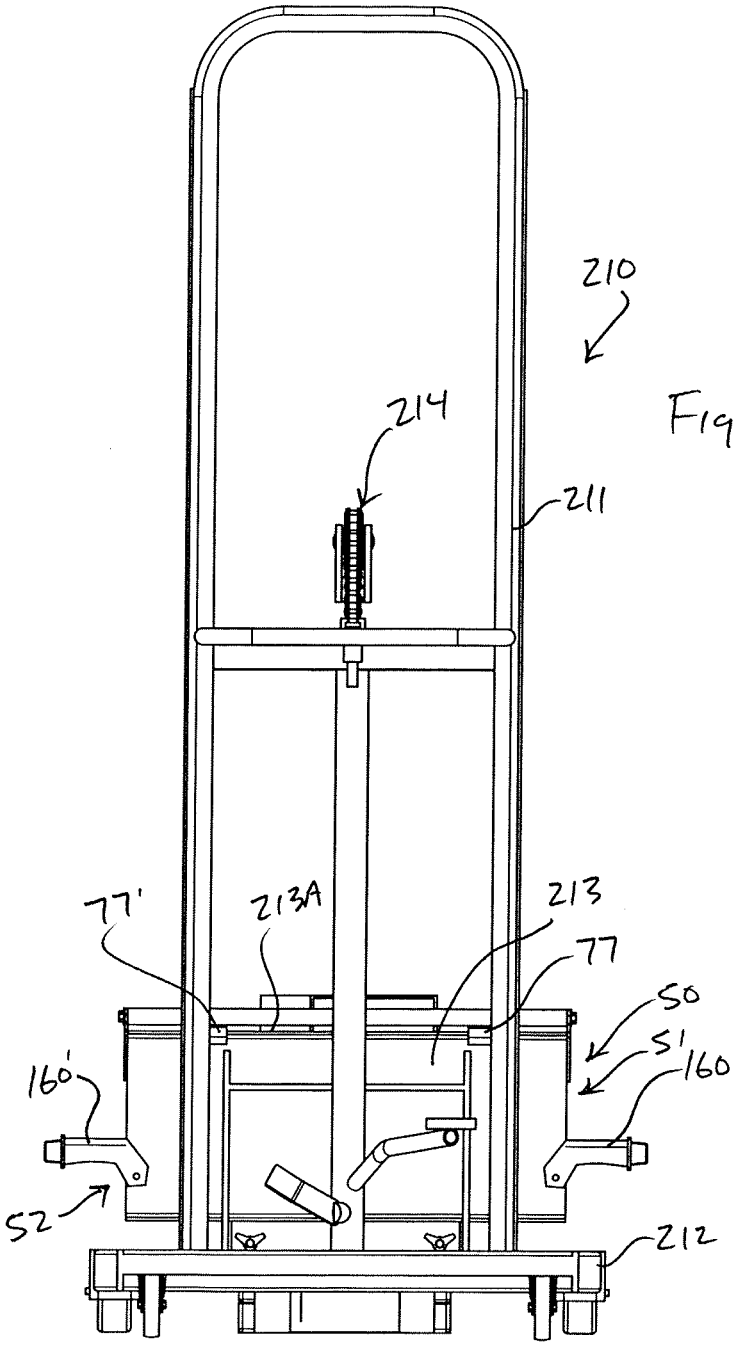
FIG. 20 is a rear elevation view of the embodiment of FIG. 16.
Figure 26:
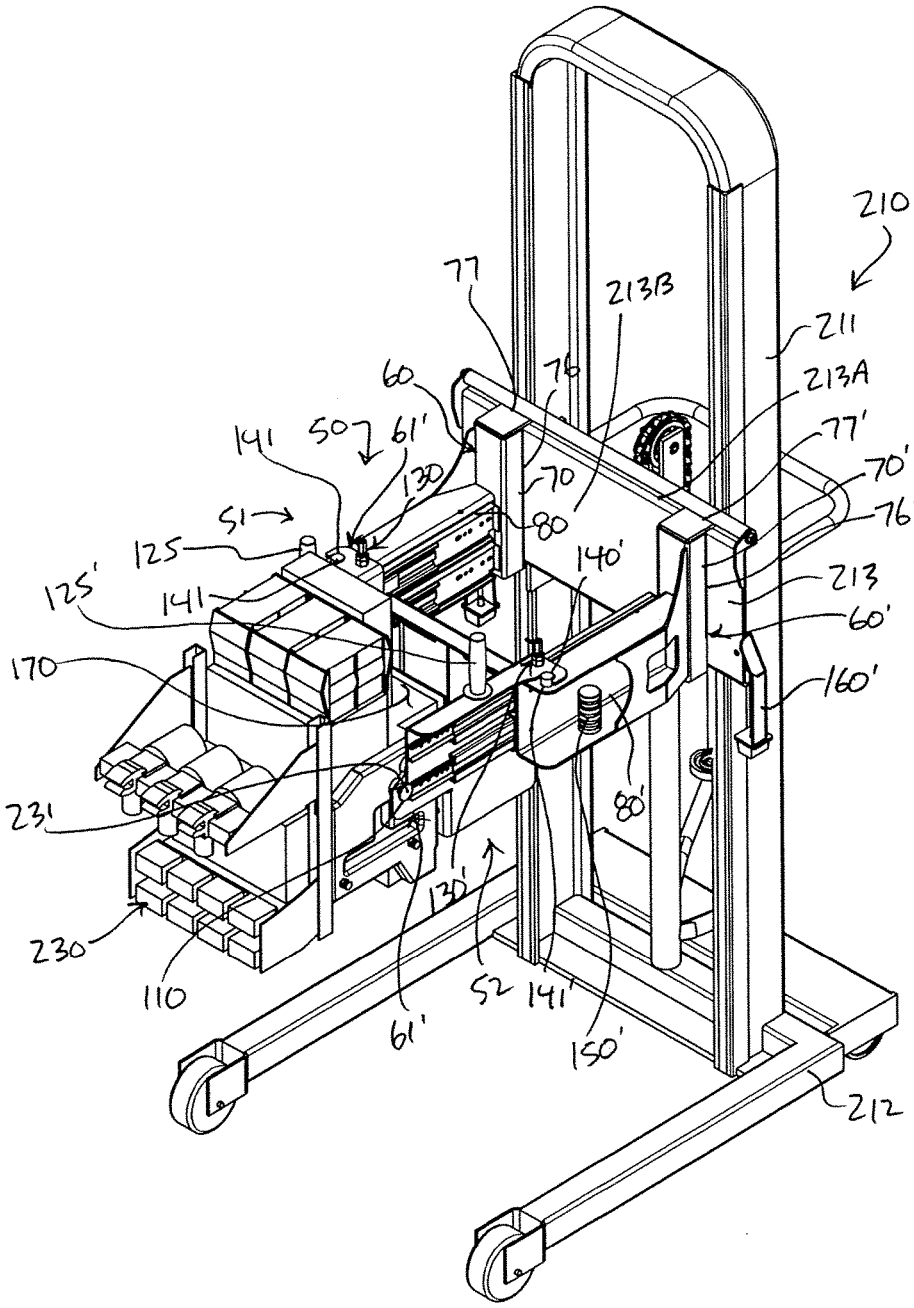
FIG. 26 is a view similar to that of FIG. 21 illustrating breaker as it would appear in an extended position corresponding to an extended position of the load-supporting apparatus.
Figure 27:
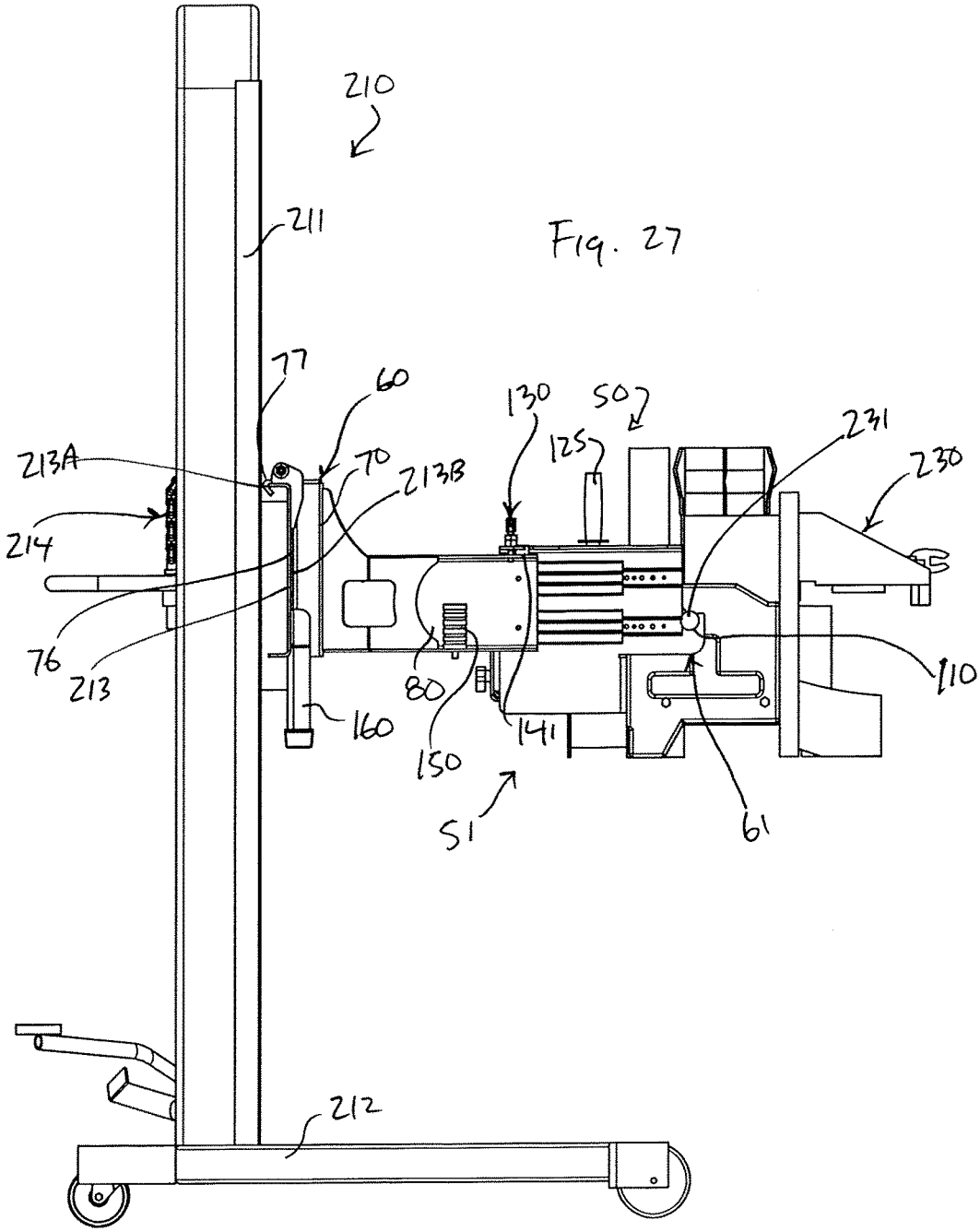
FIG. 27 is a left side elevation view of the embodiment of FIG. 26.
Figure 28:
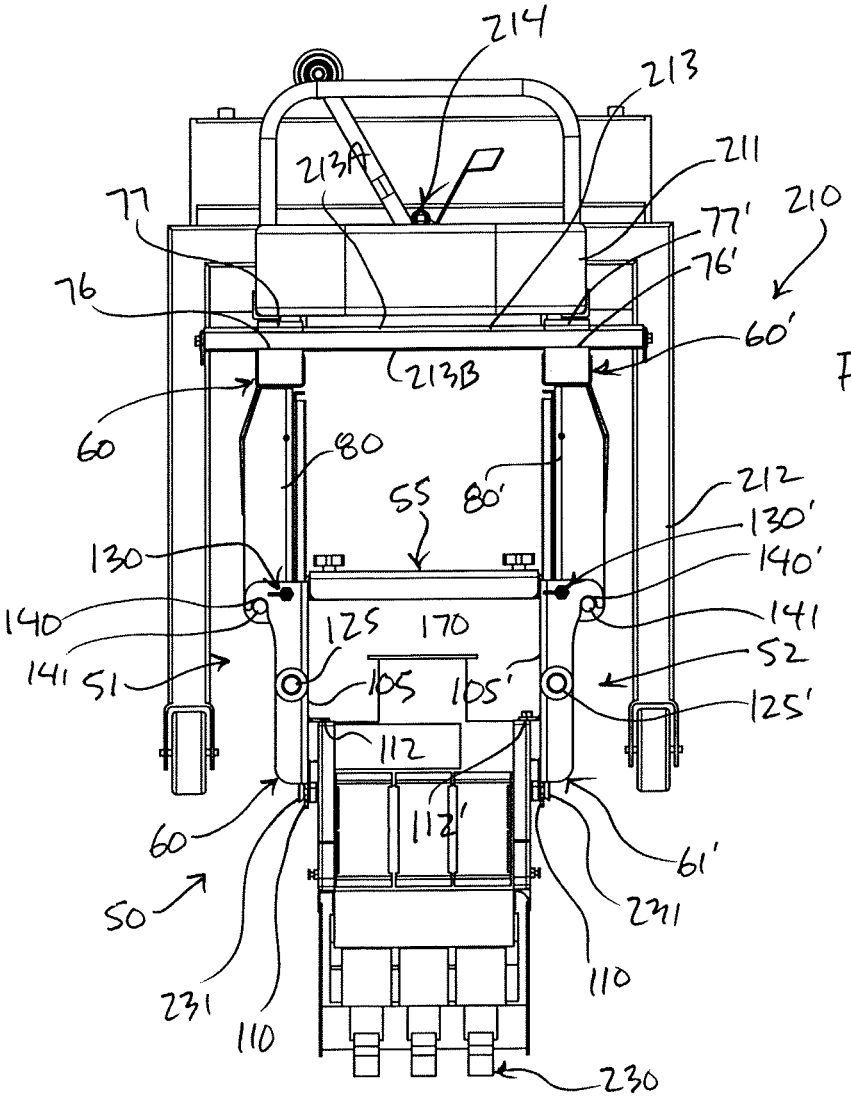
FIG. 28 is a top plan view of the embodiment of FIG. 26.

And so in FIG. 16 load-supporting apparatus 50 is carried by backboard 213, and lift 210 is operative for raising and lowering backboard 213 and for lifting and lowering load-supporting apparatus 50 mounted to backboard 213, namely, suspended from backboard 213, for, in turn, lifting and lowering a load carried by load-supporting apparatus 50. The load in FIG. 16 is a breaker 230 having opposed trunnions 231 on either side thereof as illustrated in FIGS. 16 and 17. Support assemblies 51 and 52 are distanced from one another via linkage assembly 55 to set receiving area 170 to correspond to breaker 230. Lift 210 is maneuvered to locate breaker 230, situated on the support surface over which lift 150 is set upon, in receiving area 170 and to register trunnions 231 on either side of breaker 230 with the corresponding cradles 210 and 210'. By operating lift 210, load-supporting apparatus 50 is initially raised in FIGS. 16 and 17 to take up trunnions 231, which are pivotally supported by cradles 210 and 210'. Breaker 230 pivots slightly downwardly in response until the back of breaker contacts abutments 112 and 112' in FIG. 18, which arrests pivotal movement of trunnions 231 relative to cradles 112 and 112' and stabilizes breaker 230 for lifting and lowering while so supported by slides 61 and 61' load-supporting apparatus 50. For illustration and reference, FIG. 19 is a front elevation view of the embodiment of FIG. 16, and FIG. 20 is a rear elevation view of the embodiment of FIG. 16. FIGS. 16, 17, 19, and 20 show load-supporting apparatus 50 in a lowered position supporting breaker 230 in a lowered position. FIGS. 21-25 show load-supporting apparatus 50 in a raised position via the operation of lift 50 supporting breaker 230 in a raised position. In FIGS. 16-18 and 21-23, slides 61 and 61' are shown in their retracted positions toward bases 60 and 60' and mast 21 orienting breaker 230 in a retracted position. In FIGS. 26, 27, and 28, slides 61 and 61' are shown in their extended positions away from bases 60 and 60' and mast 21 orienting breaker 230 in an extended position.

Slides 61 and 61' can be moved back-and-forth, with the use of handles 125 and 125' if chosen, between their retracted positions and their extended positions as needed for, in turn, moving breaker 230 supported by slides 61 and 61' of load-supporting apparatus 50 between a retracted position corresponding to the retracted positions of slides 61 and 61' and an extended position corresponding to the extended position of slides 61 and 61'. Slides 61 and 61' of support assemblies 51 and 52 are disabled from moving between retracted and extended positions, when lock assemblies 130 and 130' are locked in the retracted positions of slides 61 and 61' corresponding to the retracted position of breaker. When breaker 230 is in the retracted position, lift 210 may be wheeled about as needed for transporting breaker 230. To unload breaker 230 onto a chosen landing area when in the retracted position, lift 210 can be maneuvered to position breaker 230 above a landing area and load-supporting apparatus 50 can be lowered via the operation of lift 210 to set breaker 230 down on the chosen landing area, at which point continued lowering of load-supporting apparatus 50 downwardly away from breaker 230 withdraws abutments 112 and 112' from breaker 230 and withdraws cradles 110 and 110' from trunnions 231. In the alternative, lock assemblies 130 and 130' can be unlocked and sliders 61 and 61' can be moved from their retracted positions corresponding to the retracted position of breaker 230 to their extended positions in FIGS. 26-28 corresponding to the extended position of breaker 230. At this point, breaker 230 can unloaded onto a chosen landing area in the manner described above.

Figure 29:
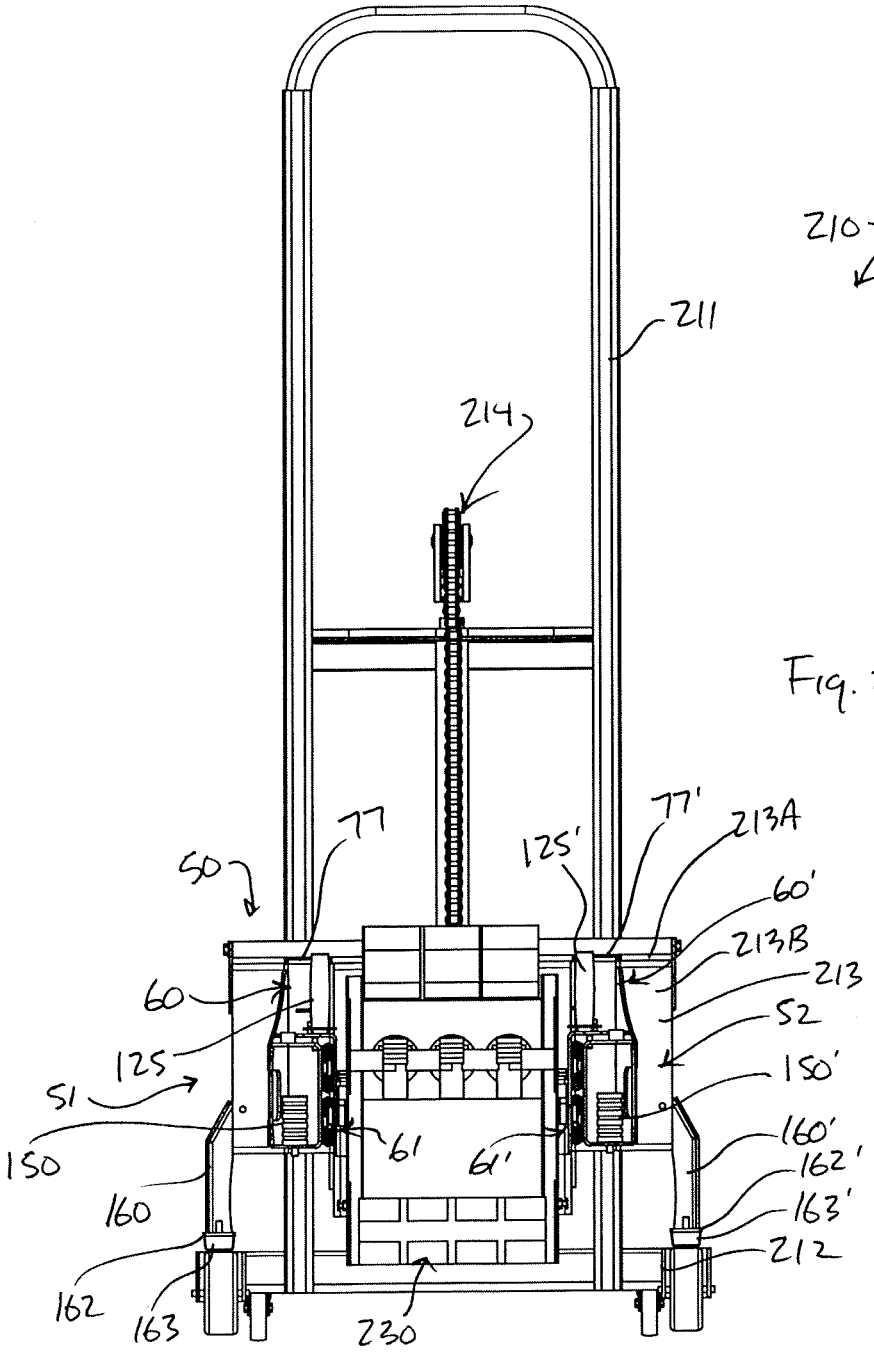
FIG. 29 is front elevation view of the embodiment of FIG. 16 illustrating braces of the load-supporting apparatus in lowered positions engaging the base of the lift.
Figure 30:
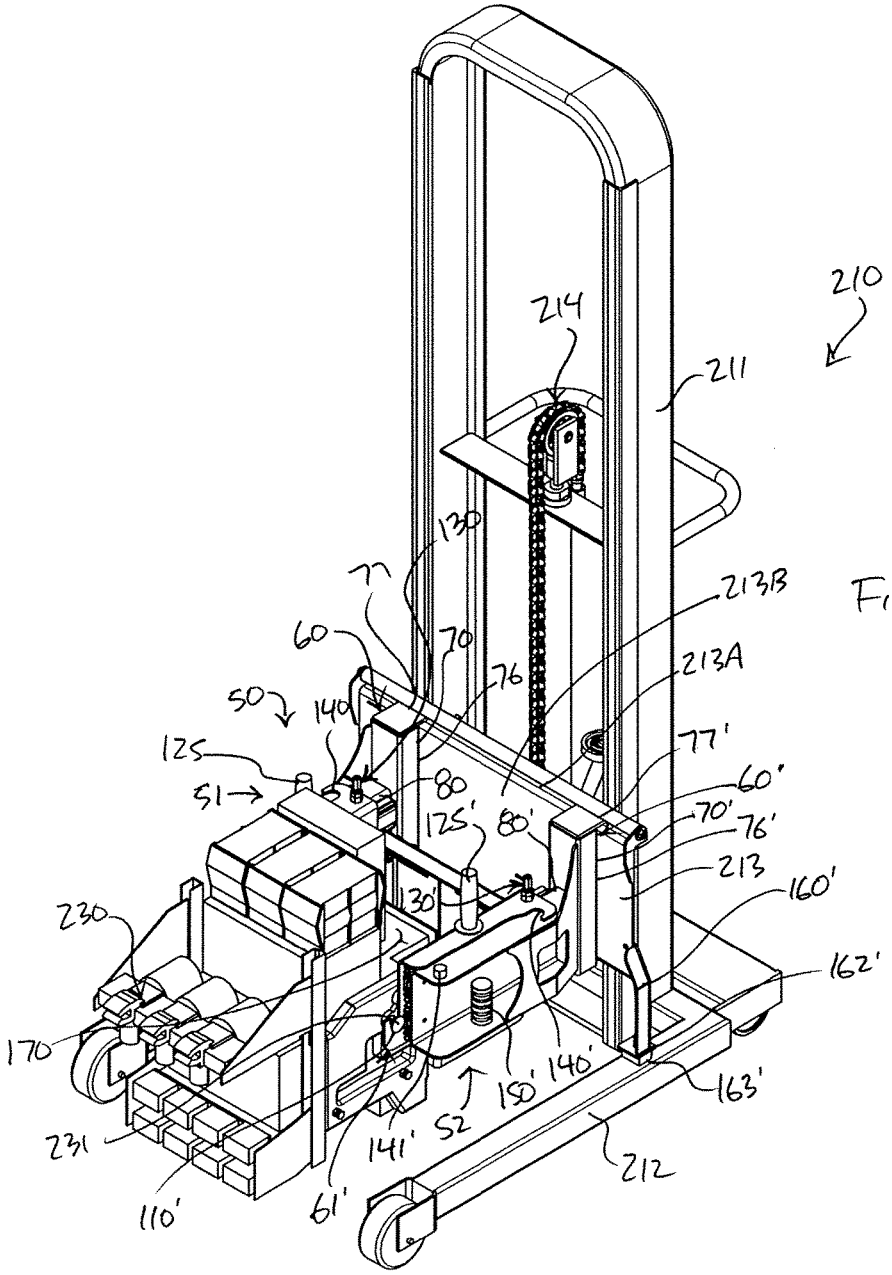
FIG. 30 is a top left perspective view of the embodiment of FIG. 29.
Figure 31:
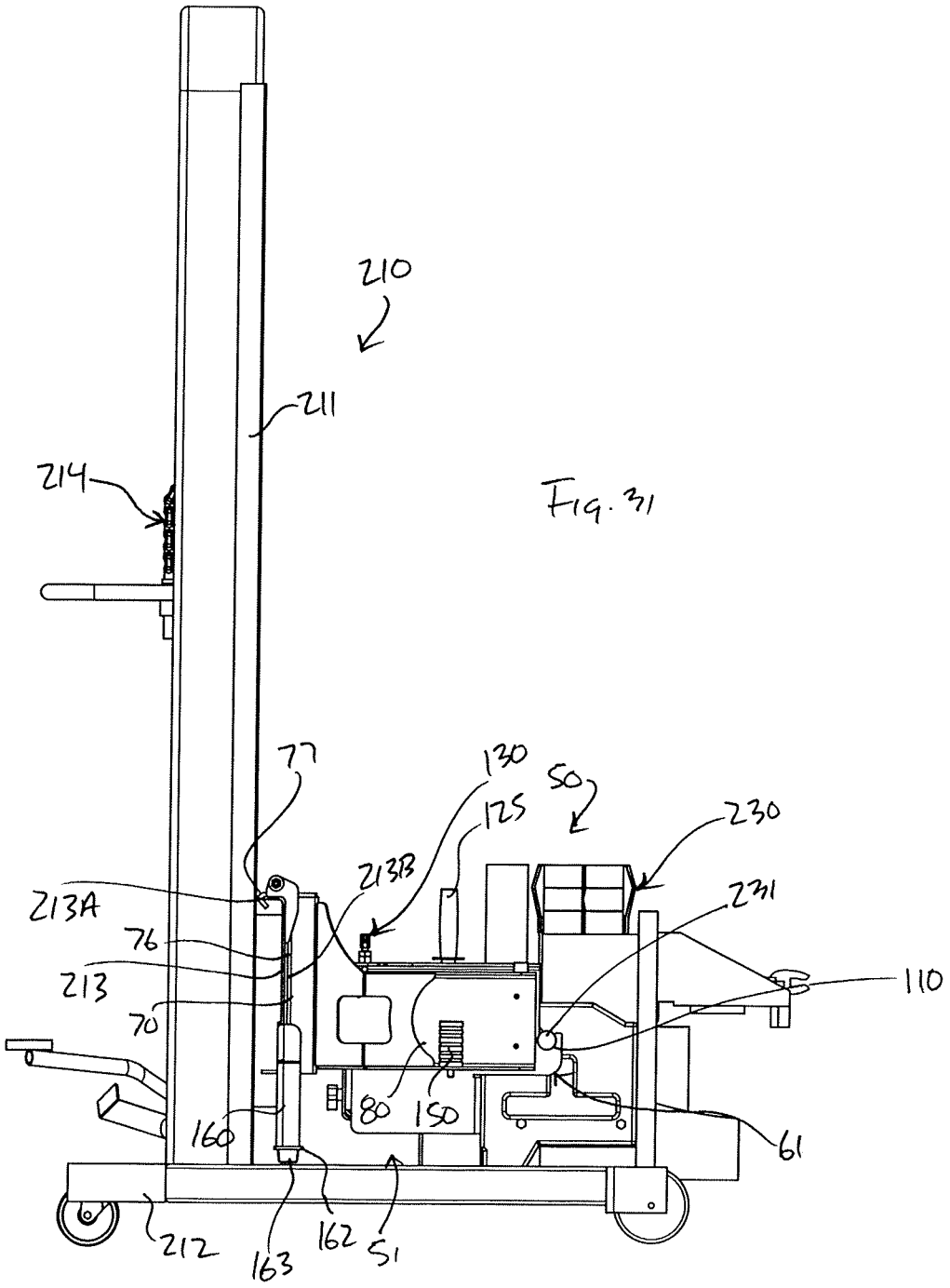
FIG. 31 is a right side elevation view of the embodiment of FIG. 29.

In FIGS. 26 and 17, braces 160 and 160' are pivoted downwardly into their lowered positions registering each foot 163 and 163' with either side of base 212. Foot 163 of brace 160 and foot 163' of brace 160 concurrently engage base 212 of lift 212 as illustrated in FIGS. 29-31 when load-supporting apparatus 50 supporting breaker 230 is lowered to a lowered position toward base 212 via the operation of lift 210, which arrests load-supporting apparatus 50 from moving past the lowered position for disabling the load supported by load-supporting apparatus 50, breaker 230 in this example, from inadvertently contacting the surface onto which lift 210 is set upon. Braces 160 and 160' can be pivoted between their raised and lowered positions as needed.

Figure 32:
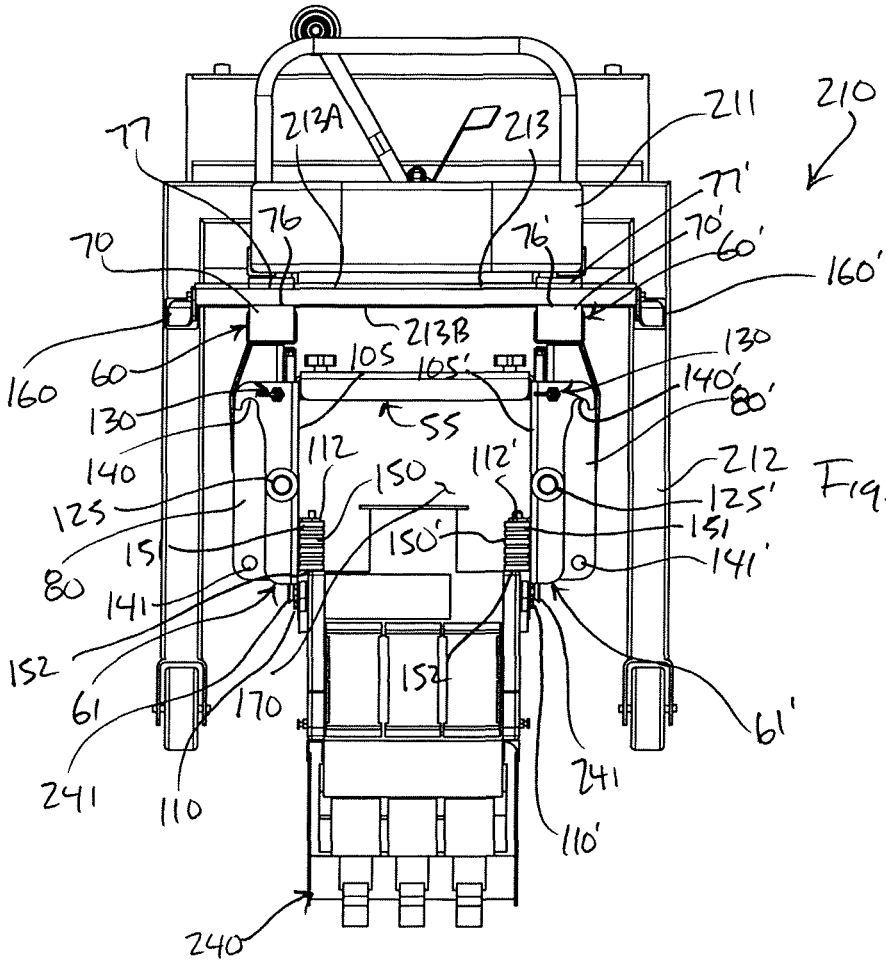
FIG. 32 is a top plan view of the load-supporting apparatus of FIG. 13 mounted the lift of FIG. 16 while supporting a breaker, the breaker shown as it would appear in a retracted position corresponding to a retracted position of the load-supporting apparatus, and the spacers shown in operative positions engaging the breaker.

In the operation of lift 210 and load-supporting apparatus 50 described in conjunction with FIGS. 16-32, spacers 150 and 150' are in their stowage positions. FIGS. 32-39 illustrate the operation of lift 210 and load-supporting apparatus 50 with spacers 150 and 150' in their operative positions when needed to correspond to breaker 240. In FIG. 32, spacers 150 and 150' are in their operative position releasably attached to abutments 112 and 112' of the respective slides 61 and 61'. Spacers 150 and 150' extend forwardly from the respective abutments 112 and 112' to distal ends 152 and 152', respectively, which define extended contact points, respectively, of slides 61 and 61' spaced forwardly from the contact points defined by the respective abutments 112 and 112'. The extended contact points defined by distal ends 152 and 152', respectively, are used to engage and stabilize a load relative to support assemblies 51 and 52, when the load is between and is supported by slides 61 and 61', such as when trunnions of the load are pivotally supported by the respective cradles 112 and 112' of slides 61 and 61'.

Figure 33:
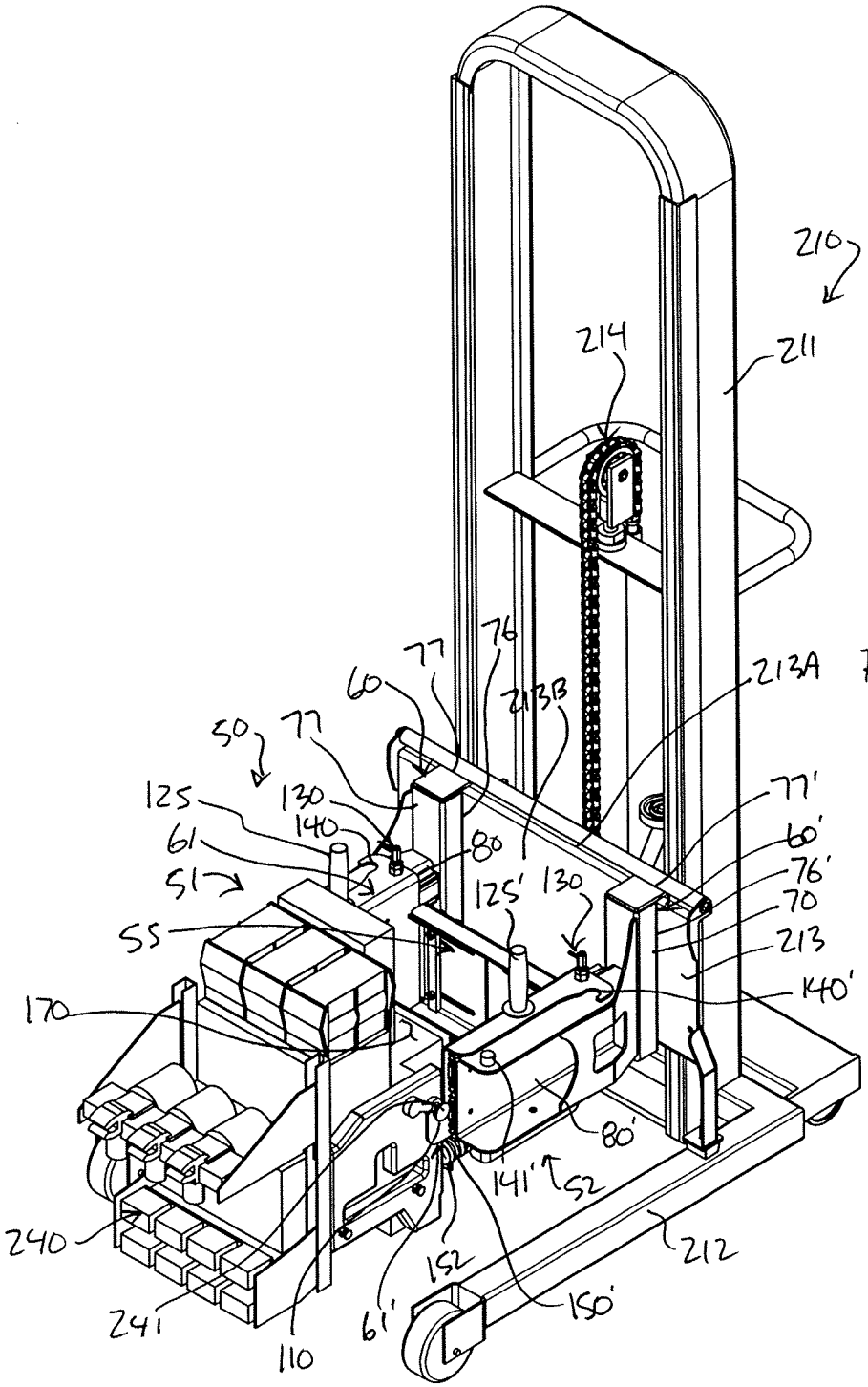
FIG. 33 is a top left perspective view of the embodiment of FIG. 32 illustrating a brace of the load-supporting apparatus in a lowered position engaging the base of the lift.
Figure 34:
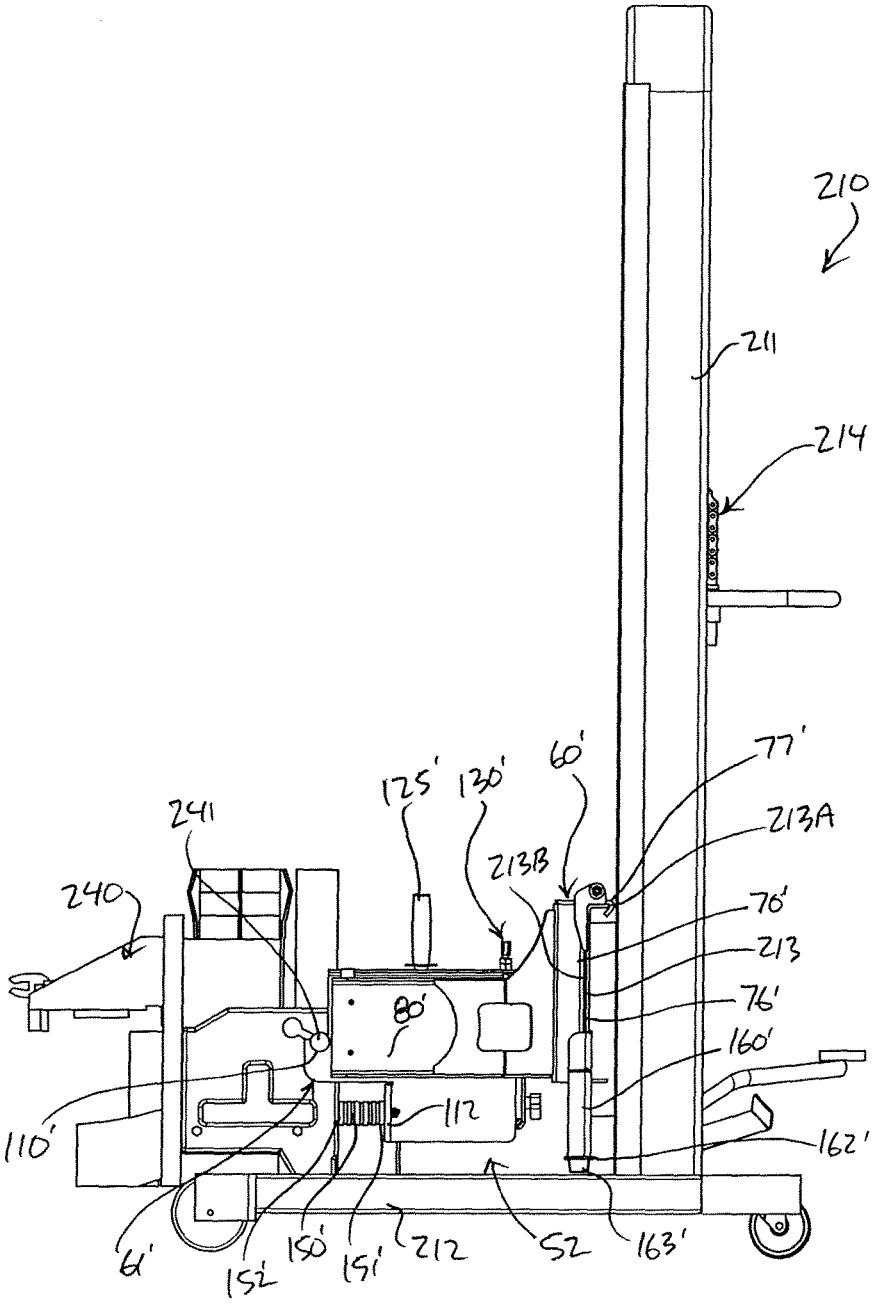
FIG. 34 is a left side elevation view of the embodiment of FIG. 22
Figure 35:
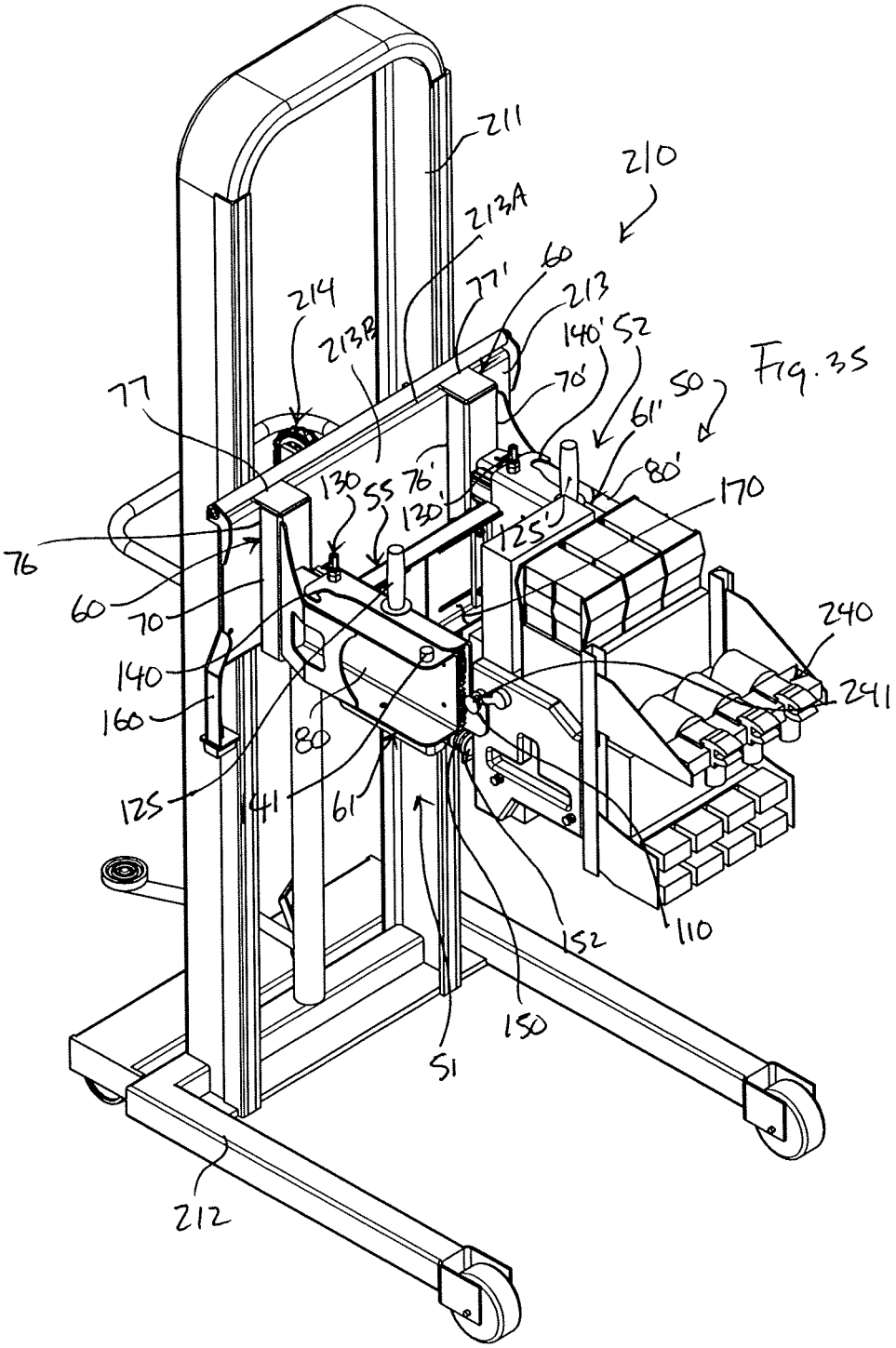
FIG. 35 is a top right perspective view of the embodiment of FIG. 32 illustrating the breaker in a raised position corresponding to a raised position of the load-supporting apparatus.
Figure 36:
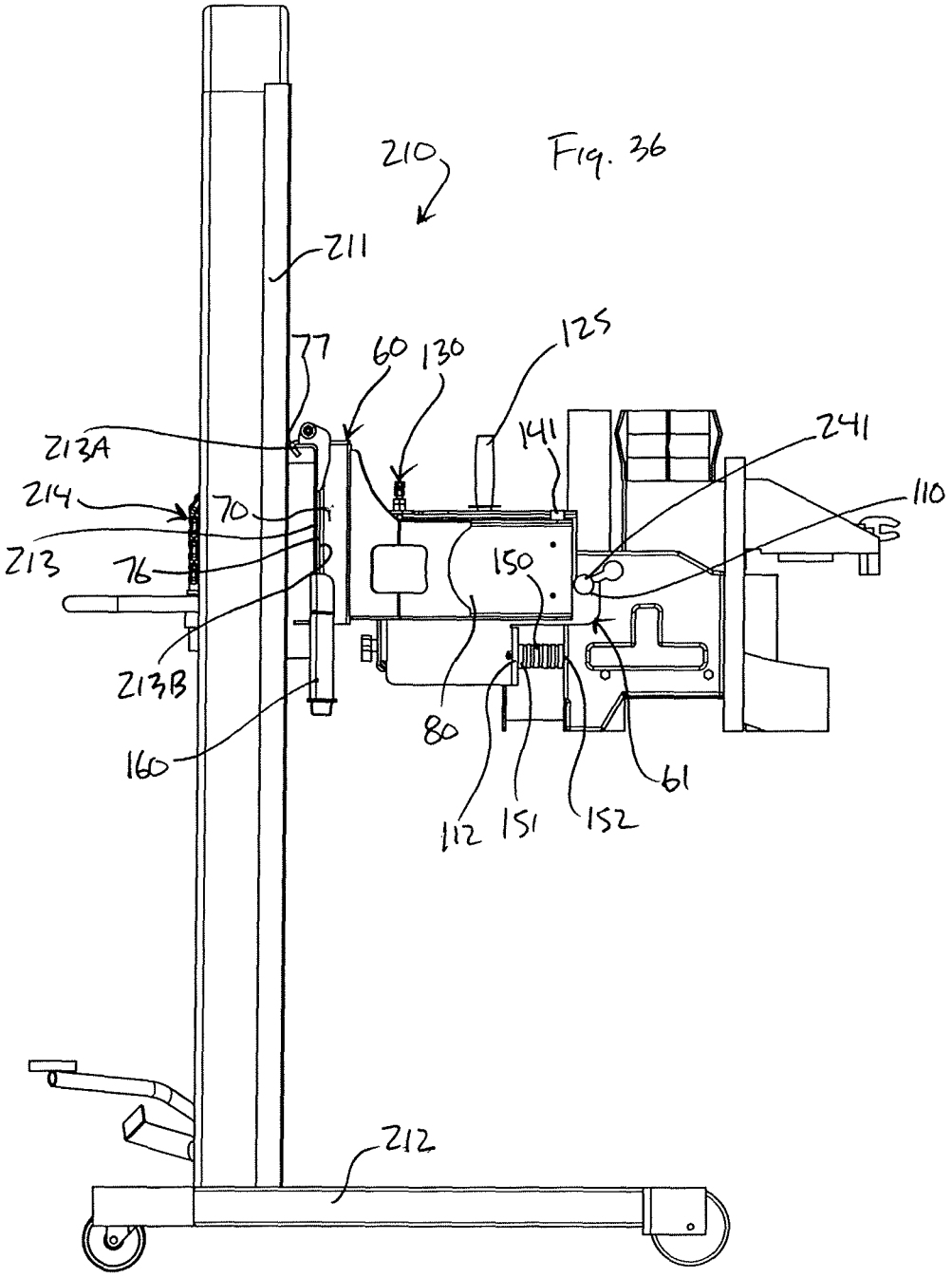
FIG. 36 is a left side elevation view of the embodiment of FIG. 35.
Figure 37:
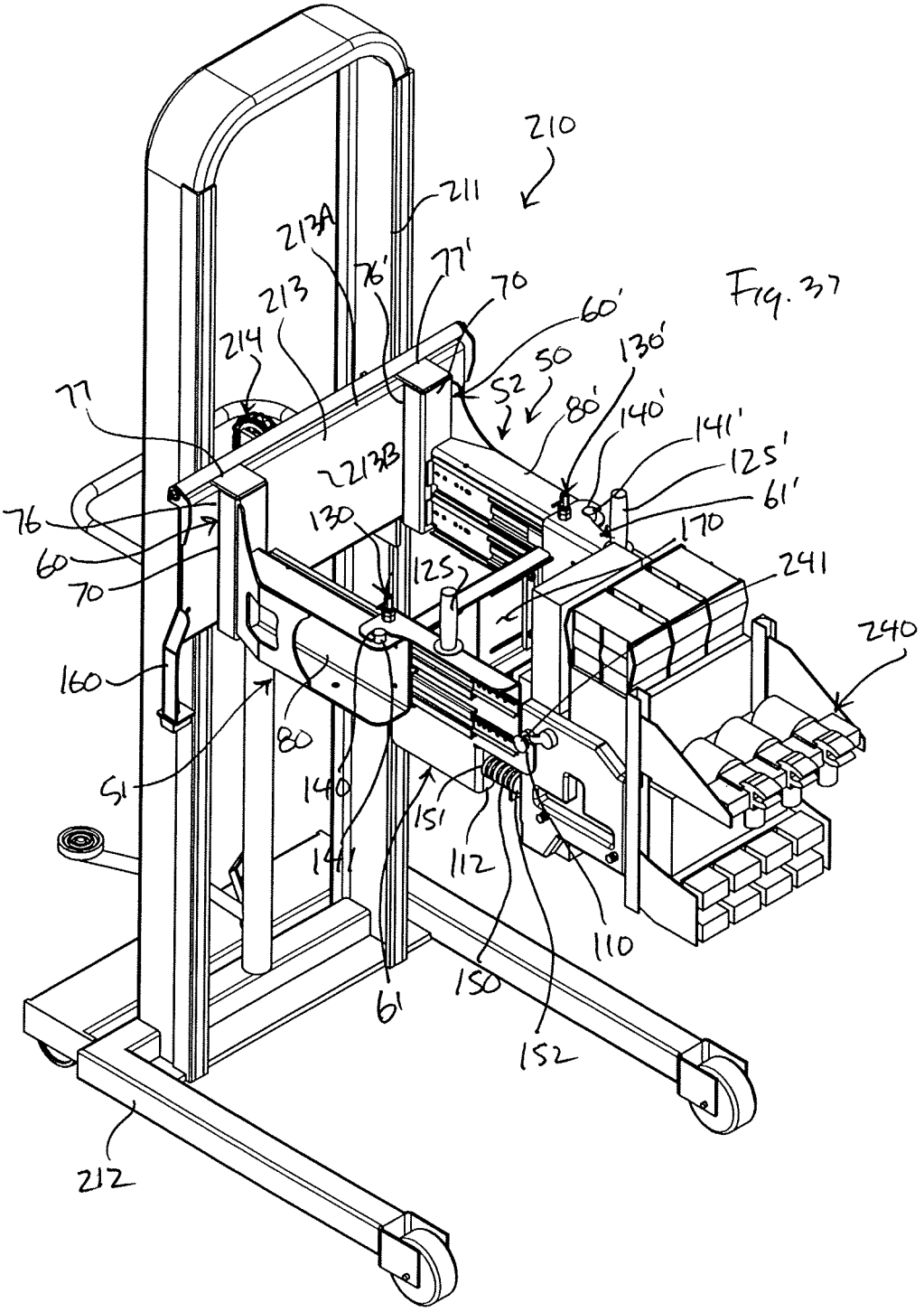
FIG. 37 is a view similar to that of FIG. 35 illustrating the breaker as it would appear in an extended position corresponding to an extended position of the load-supporting apparatus.
Figure 38:
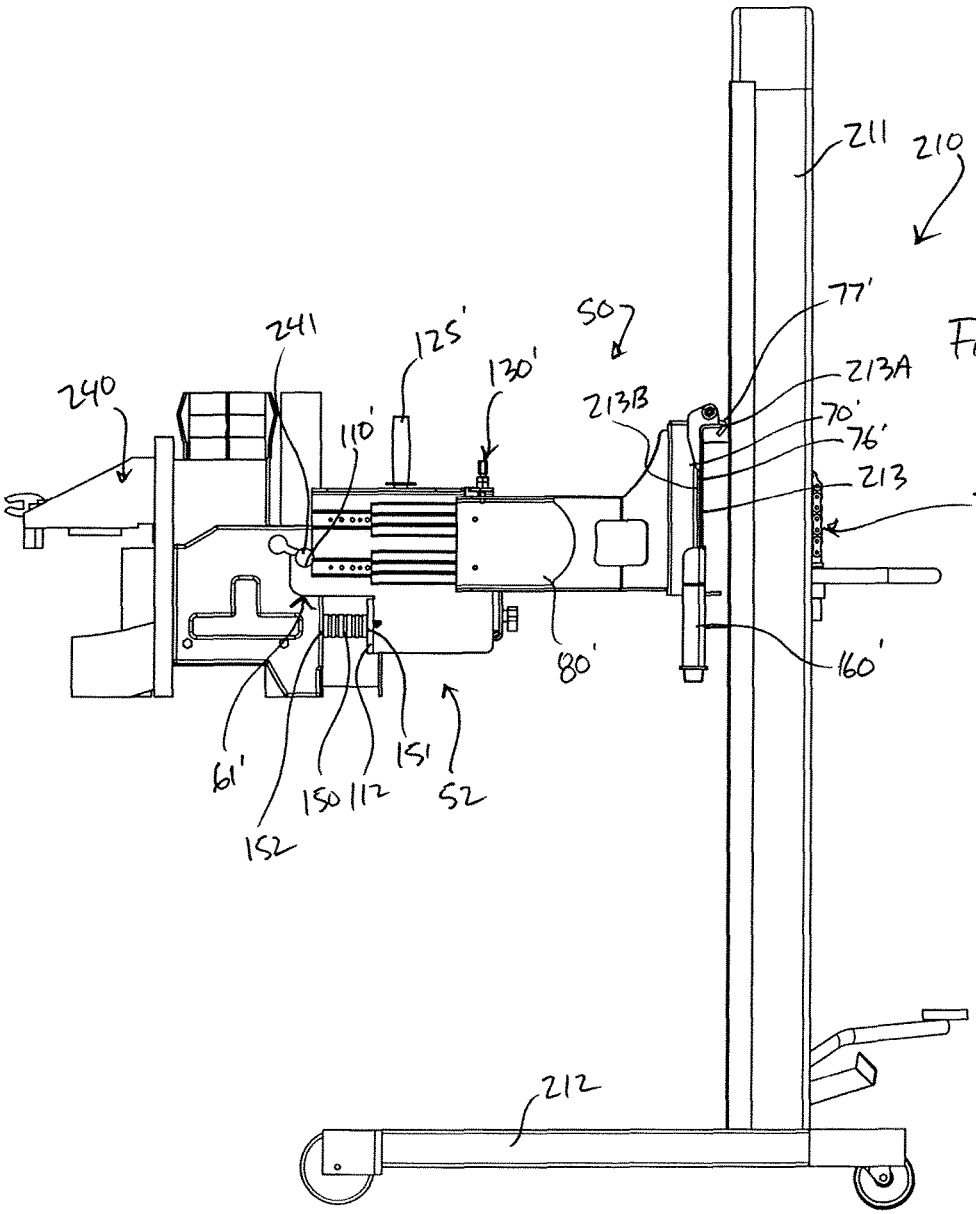
FIG. 38 is a left side elevation view of the embodiment of FIG. 37.
Figure 39:
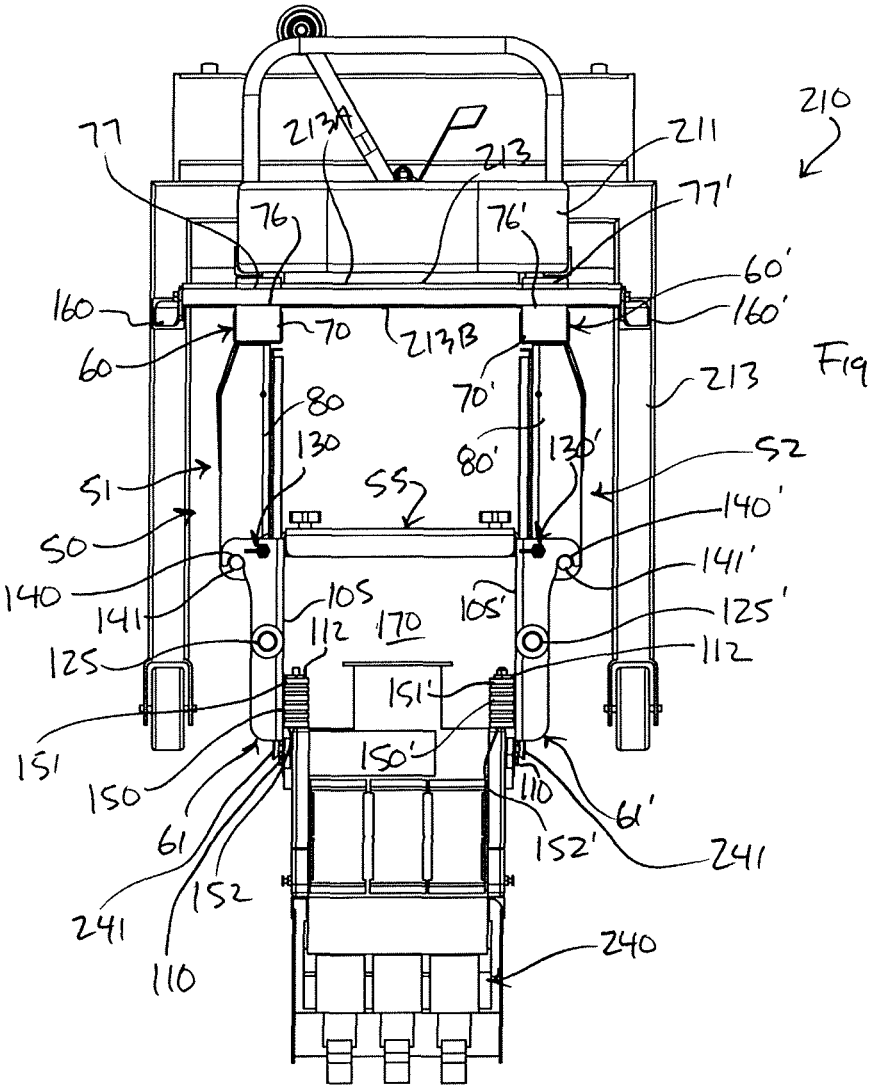
FIG. 39 is a top plan view of the embodiment of FIG. 37.

In FIGS. 32-39, load-supporting apparatus 50 is carried by backboard 213, lift 210 is operative for raising and lowering backboard 213 and for lifting and lowering load-supporting apparatus 50 mounted to backboard 213, namely, suspended from backboard 213, for, in turn, lifting and lowering a load carried by load-supporting apparatus 50, and spacers 150 and 150' are in their operative positions. The load in FIGS. 32-39 is a breaker 240 having opposed trunnions 241 on either side thereof. Support assemblies 51 and 52 are distanced from one another via linkage assembly 55 to set receiving area 170 to correspond to breaker 240. In FIG. 33, lift 210 is maneuvered to locate breaker 240, situated on the support surface over which lift 150 is set upon, in receiving area 170 and to register trunnions 241 on either side of breaker 240 with the corresponding cradles 210 and 210'. By operating lift 210, load-supporting apparatus 50 is initially raised to take up trunnions 241, which are pivotally supported by cradles 210 and 210'. Breaker 240 pivots slightly downwardly in response until the back of breaker contacts distal ends 152 and 152' of spacers 150 and 150' shown in relevant part in FIGS. 32-34, which arrests pivotal movement of trunnions 241 relative to cradles 112 and 112' and stabilizes breaker 240 for lifting and lowering while so supported by slides 61 and 61' load-supporting apparatus 50. FIGS. 33 and 34 show load-supporting apparatus 50 in a lowered position supporting breaker 240 in a lowered position, and FIG. 32 is a top plan view corresponding FIGS. 33 and 34. FIGS. 35 and 36 show load-supporting apparatus 50 in a raised position via the operation of lift 50 supporting breaker 240 in a raised position. In FIGS. 32-36, slides 61 and 61' are shown in their retracted positions toward bases 60 and 60' and mast 21 orienting breaker 240 in a retracted position. Slides 61 and 61' are in their extended positions away from bases 60 and 60' and mast 21 orienting breaker 240 in an extended position in FIGS. 37-39.

Again, slides 61 and 61' can be moved back-and-forth, with the use of handles 125 and 125' if chosen, between their retracted positions and their extended positions as needed for, in turn, moving breaker 240 supported by slides 61 and 61' of load-supporting apparatus 50 between a retracted position corresponding to the retracted positions of slides 61 and 61' and an extended position corresponding to the extended position of slides 61 and 61'. Slides 61 and 61' of support assemblies 51 and 52 are disabled from moving between retracted and extended positions, when lock assemblies 130 and 130' are locked in the retracted positions of slides 61 and 61' corresponding to the retracted position of breaker. When breaker 240 is in the retracted position, lift 210 may be wheeled about as needed for transporting breaker 240. To unload breaker 240 onto a chosen landing area when in the retracted position, lift 210 can be maneuvered to position breaker 240 above a landing area and load-supporting apparatus 50 can be lowered via the operation of lift 210 to set breaker 240 down on the chosen landing area, at which point continued lowering of load-supporting apparatus 50 downwardly away from breaker 240 withdraws distal ends 152 and 152' of spacers 150 and 150' from breaker 240 and withdraws cradles 110 and 110' from trunnions 241. In the alternative, lock assemblies 130 and 130' can be unlocked and slides 61 and 61' can be can be moved from their retracted positions corresponding to the retracted position of breaker 240 to their extended positions in FIGS. 26-28 corresponding to the extended position of breaker 240. At this point, breaker 240 can unloaded onto a chosen landing area in the manner described above.

Those having regard for the art will readily appreciate that an exemplary load-supporting apparatus 50 and lift 210 formed therewith are disclosed. Load-supporting apparatus 50 is simple in structure, easily mounted releasably to a lift for lifting and lowering load-supporting apparatus 50 and a load supported thereby, easily adjustable for accommodating loads of varying size, and easily detached from the lift. In the exemplary embodiments disclosed above, cradles 110 and 110' pivotally support a load the is braced against abutments 112 and 112' of slides 61 and 61' in one configuration of load-supporting apparatus 50, and that is braced against extended contact points of slides 61 and 61' defined by distal ends 152 and 152' of spacers 150 in their operative positions when needed to relate to the load to be lifted. Load-supporting apparatus 50 is adjustable to accommodate loads of varying size, is easily suspended from a lift operable for raising and lowering load-supporting apparatus 50 without the use of separate tools and without having to modify load-supporting apparatus 50 or lift 210 or backboard 213 of lift 210 and without the need for separate mechanical fasteners, and is easily removed from the lift for maintenance, repair or replacement simply by lifting load-support apparatus 50 away from the lift.

The invention has been described above with reference to illustrative embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus, comprising:

a load-supporting apparatus mountable releasably to a lift operable for raising and lowering the load-supporting apparatus between raised and lowered positions, the load-supporting apparatus includes first and second support assemblies each including a base and a beam, including an abutment, mounted to the base, the first and second support assemblies are axially spaced and extend in the same direction, the beams are configured to support a load positioned therebetween, and the abutments define contact points that engage and stabilize a load relative to the first and second support assemblies, when the load is between and is supported by the beams;

the first and second support assemblies each further include a spacer, an engagement element carried by the spacer, a complemental engagement element carried by the beam, the spacer is releasably attached to the beam extending forwardly from the abutment, when the engagement element is releasably engaged to the complemental engagement element, and the spacers define extended contact points spaced forwardly from the contact points of the respective abutments that engage and stabilize the load relative to the first and second support assemblies, when the load is between and is supported by the beams.

2. The apparatus according to claim 1, further comprising a linkage assembly coupling the first support assembly to the second support assembly.

3. The apparatus according to claim 2, wherein the linkage assembly is adjustable for enabling adjustment of the first and second support assemblies toward and away from one another.

4. The apparatus according to claim 1, wherein the second complemental engagement elements are carried by the abutments of the respective first and second support assemblies.

5. The apparatus according to claim 1, further comprising:

a cradle formed in the distal end of each said beam; and the contact points engage and stabilize the load relative to the first and second support assemblies, when the load is between the beams and when trunnions of the load are supported by the respective cradles of the beams.

6. Apparatus, comprising:

a backboard mounted to a lift for moving the backboard in lifting and lowering directions, the backboard includes an upper edge and a front surface;

a load-supporting apparatus, the load-supporting apparatus includes a linkage assembly coupling a first support assembly to a second support assembly, the first and second support assemblies each include a base, having a hook, and a beam mounted to the base, the first and second support assemblies are axially spaced and extend in the same direction, the beams are configured to support a load positioned therebetween, and the linkage assembly is adjustable for enabling adjustment of the first and second support assemblies toward and away from one another;

the load-supporting apparatus is suspended from the backboard with the hooks, the hooks are hooked over the upper edge of the backboard, the bases of the first and second support assemblies depend downwardly against the front surface of the backboard, and the beams of the respective first and second support assemblies concurrently extend forwardly from the linkage assembly, the bases of the respective first and second support assemblies, and the front surface of the backboard; and the hooks and the bases are slidable back-and-forth across the upper edge and the front surface, respectively, of the backboard, which enables adjustment of the first and second support toward and away from one another via the linkage assembly.

7. The apparatus according to claim 6, wherein:

the linkage assembly is capable of being locked and unlocked;

the first and second support assemblies are disabled from moving toward and away from one another via the linkage assembly, when the linkage assembly is locked; and the first and second support assemblies are enabled for moving toward and away from one another via the linkage assembly, when the linkage assembly is unlocked.

8. Apparatus, comprising a load-supporting apparatus mountable releasably to a lift operable for raising and lowering the load-supporting apparatus between raised and lowered positions, the load-supporting apparatus includes first and second support assemblies each comprising a base and a beam mounted to the base, the first and second support assemblies are axially spaced and extend in the same direction, and the beams are configured to support a load positioned therebetween; and the first and second support assemblies each further include a brace that depends downwardly to a foot, and the foot of each of the braces engages a base of the lift, when the load-supporting apparatus is mounted to the lift and the load-supporting apparatus is in the lowered position.

9. The apparatus according to claim 8, further comprising a linkage assembly coupling the first support assembly to the second support assembly.

10. The apparatus according to claim 9, wherein the linkage assembly is adjustable for enabling adjustment of the first and second support assemblies toward and away from one another.

11. The apparatus according to claim 10, further comprising:

the linkage assembly is capable of being locked and unlocked;

the first and second support assemblies are disabled from moving toward and away from one another via the linkage assembly, when the linkage assembly is locked; and the first and second support assemblies are enabled for moving toward and away from one another via the linkage assembly, when the linkage assembly is unlocked.

* * * * *